US007647671B2

(12) United States Patent
Yoshimura et al.

(10) Patent No.: US 7,647,671 B2
(45) Date of Patent: Jan. 19, 2010

(54) SUCTION CLEANER

(75) Inventors: Hiroshi Yoshimura, Osaka (JP); Noboru Nishinaka, Wakayama (JP); Susumu Hamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 983 days.

(21) Appl. No.: 10/494,020

(22) PCT Filed: Nov. 8, 2002

(86) PCT No.: PCT/JP02/11708

§ 371 (c)(1),
(2), (4) Date: Oct. 15, 2004

(87) PCT Pub. No.: WO03/041552

PCT Pub. Date: May 22, 2003

(65) Prior Publication Data

US 2005/0039296 A1 Feb. 24, 2005

(30) Foreign Application Priority Data

Nov. 12, 2002 (JP) ..... 2001-345619

(51) Int. Cl.
*A47L 5/28* (2006.01)

(52) U.S. Cl. ..... 15/334; 15/332; 15/416

(58) Field of Classification Search ..... 15/331, 15/332, 333, 334, 416, 415.1, 419
See application file for complete search history.

(56) References Cited

U.S. PATENT DOCUMENTS 1,726,592 A * 9/1929 Spanel ..... 15/332
3,936,903 A 2/1976 Johnson
5,008,973 A 4/1991 Woerwag et al.
5,355,549 A * 10/1994 Steinberg et al. ..... 15/334
5,398,373 A 3/1995 Blase et al.
5,416,948 A 5/1995 Woerwag et al.
5,504,970 A 4/1996 Neshat et al.

(Continued)

FOREIGN PATENT DOCUMENTS

JP 59-131323 7/1984

(Continued)

OTHER PUBLICATIONS

Chinese Office Action for corresponding Application No. 02822392.6 dated Nov. 8, 2002.

*Primary Examiner*—Lee D Wilson
(74) *Attorney, Agent, or Firm*—Renner, Otto, Boisselle & Sklar, LLP

(57) ABSTRACT

A suction cleaner that sucks in dust, from a suction mouth of a suction mouth body, with airflow generated through operation of an electric air blower and introduces the sucked airflow into a dust collection device to collect the dust. The suction mouth body is provided with a first suction mouth and a second suction mouth. An agitator is arranged at the first suction mouth. The first suction mouth is selected by a suction mouth-switching device, and the agitator is driven when the suction is carried out from the first suction mouth. A mechanism for transmitting power to the agitator includes a driving pulley that co-rotates with the agitator, an idler that can be rotated independently of the agitator, and a belt that is shifted between the driving pulley and the idler by a belt-switching device.

8 Claims, 22 Drawing Sheets

U.S. PATENT DOCUMENTS

| | | | | |
|---|---|---|---|---|
| 6,018,845 | A * | 2/2000 | Sueki et al. | 15/375 |
| 6,039,817 | A | 3/2000 | Payne | |
| 6,079,077 | A * | 6/2000 | Kajihara et al. | 15/332 |
| 6,400,048 | B1 * | 6/2002 | Nishimura et al. | 310/47 |
| 7,069,619 | B2 * | 7/2006 | Bowden et al. | 15/335 |
| 2005/0039296 | A1 * | 2/2005 | Yoshimura et al. | 15/334 |
| 2005/0060839 | A1 * | 3/2005 | Nishinaka et al. | 15/418 |
| 2006/0130267 | A1 * | 6/2006 | Oka et al. | 15/332 |

FOREIGN PATENT DOCUMENTS

| | | |
|---|---|---|
| JP | 60-109562 | 7/1985 |
| JP | 62-104745 | 7/1987 |
| JP | 4-343818 | 11/1992 |
| JP | 2000-300479 | 10/2000 |

* cited by examiner

SUCTION CLEANER

TECHNICAL FIELD

The present invention relates to a suction cleaner, and particularly to the construction of the suction mouth portion thereof.

BACKGROUND ART

A suction cleaner sucks in, along with an air stream produced as an electric blower is operated, dust through a suction mouth, and then introduces the air stream thus sucked in into a dust collecting device to collect the dust. These days, for houses fitted with carpets, many suction cleaners are, at their suction mouth, provided with an agitator for raking dust off a carpet. Examples of suction cleaners provided with an agitator are disclosed in Japanese Patent Applications Laid-Open Nos. S61-191329 and H8-164095. An example of a device for switching whether or not to drive an agitator is disclosed in Japanese Patent Application Laid-Open No. H6-154134.

An suction cleaner provided with an agitator at its suction mouth is not necessarily fit for all types of floor. Operating an agitator on a floor laid with flooring or linoleum may damage the floor. Moreover, a suction mouth fitted with an agitator is difficult to move close to corners formed between a floor and a wall or a piece of furniture. This makes it impossible to apply a powerful suction pressure in such places.

DISCLOSURE OF THE INVENTION

According to the present invention, in a suction cleaner that sucks in, along with an air stream produced as an electric blower is operated, dust through a suction mouth formed in a suction mouth unit and then introduces the air stream thus sucked in into a dust collecting device to collect the dust, a plurality of suction mouths including a first suction mouth are formed in the suction mouth unit, another suction mouth is formed in at least part of a region in front of the first suction mouth, an agitator is arranged in the first suction mouth, a suction mouth switching device is provided that permits selective use of the plurality of suction mouths, and the agitator is driven when suction is performed through the first suction mouth. With this construction, it is possible to selectively use different suction mouths according to whether or not to use the agitator, as on a floor surface where the use of the agitator is desirable, in particular on a carpet, and on a floor surface where the use of the agitator is undesirable. Moreover, when the first suction mouth is selected, the agitator can be driven and, otherwise, the agitator cannot be driven. This prevents the agitator from being driven when a suction mouth that is not fitted with an agitator is selected. Furthermore, whereas the first suction mouth fitted with the agitator cannot be brought close to a corner where a floor meets a wall or a piece of furniture, making it difficult to apply a powerful suction pressure in such a place, the other suction mouth formed in front of the first suction mouth can be brought close to such a corner, making it possible to apply a powerful suction pressure there.

In the suction cleaner constructed as described above, the agitator is driven with motive power different from that with which the electric blower is driven. With this construction, it is possible to simplify the mechanism for coordinating the switching to the first suction mouth with the driving of the agitator, and also to achieve that coordination easily.

In the suction cleaner constructed as described above, a motive power transmission mechanism for transmitting motive power to the agitator includes a drive pulley that rotates together with the agitator, an idler that can rotate independently of the agitator, and a belt that is shifted by a belt shifting device between a state in which it is wound on the drive pulley and a state in which it is wound on the idler. With this construction, it is possible to wind the belt on the idler to stop the agitator. Moreover, it is possible to derive motive power from the electric blower by way of the belt. This helps produce the mechanism for driving the agitator at low cost.

In the suction cleaner constructed as described above, of the suction mouth switching device and the belt shifting device, one is arranged on one of the left-hand and right-hand sides of the suction mouths and the other is arranged on the other side of the suction mouths, and the suction mouth switching device and the belt shifting device are linked together by coordinating means so that the switching between the suction mouths and the switching of the belt are performed in a coordinated fashion. With this construction, it is possible to effectively use the spaces inside the suction mouths. It is particularly advisable to fit a cleaner main unit into a C-shaped suction mouth unit, arrange the suction mouth switching device on one side of the suction mouth unit, and arrange the belt shifting device on the other side thereof. This permits a predetermined part of the suction mouth switching device and a predetermined part of the belt shifting device to be arranged so as to overlap each other on the left-hand and right-hand sides of the cleaner main unit. This helps reduce the dimensions of the suction mouth unit, in particular its dimension in the front/rear direction.

In the suction cleaner constructed as described above, when one of the suction mouth switching device and the belt shifting device is operated, the other is operated in a coordinated fashion therewith. With this construction, selecting the first suction mouth in combination with the driving of the agitator does not require individually operating the suction mouth switching device and the belt shifting device. This helps enhance usability.

In the suction cleaner constructed as described above, the belt shifting device can be operated also in an uncoordinated fashion with the suction mouth switching device. With this construction, it is possible to use the first suction mouth without driving the agitator. This makes it easy to perform cleaning on a floor surface, such as a thin carpet, where a comparatively gentle suction pressure needs to be applied in a wide area.

In the suction cleaner constructed as described above, a cleaner main unit is rotatably coupled to the suction mouth unit, and the driving of the agitator is stopped coordinatedly when the cleaner main unit is brought into a storage posture. With this construction, bringing the cleaner main unit into the storage posture forces the agitator to stop. This prevents a floor from being damaged (or pile of a carpet from being plucked off) as a result of the agitator continuing to rotate at one place, and also prevents the agitator itself from being worn.

In the suction cleaner constructed as described above, the suction mouth switching device includes a switch valve of which the valve shaft has a lever formed integrally therewith, and the lever is used as a component belonging to the coordinating means. With this structure, it is possible to increase the rigidity of the coordinating means and thereby achieve more reliable coordinating action.

In the suction cleaner constructed as described above, a second suction mouth having a smaller opening area than the first suction mouth is formed near the first suction mouth. With this construction, it is possible to perform cleaning by sucking in a high-speed air stream through the second suction mouth. Thus, on a hard floor on which dust does not need to be raked up by the agitator, the second suction mouth can be used without the risk of damaging the floor with the agitator.

In the suction cleaner constructed as described above, a cleaner main unit is rotatably coupled to the suction mouth unit, and the driving of the agitator is stopped, by shifting the belt, coordinatedly when the cleaner main unit is brought into a storage posture. With this construction, bringing the cleaner main unit into the storage posture forces the agitator to stop. This prevents a floor from being damaged (or pile of a carpet from being plucked off) as a result of the agitator continuing to rotate at one place, and also prevents the agitator itself from being worn.

BEST MODE FOR CARRYING OUT THE INVENTION

Figure 1:
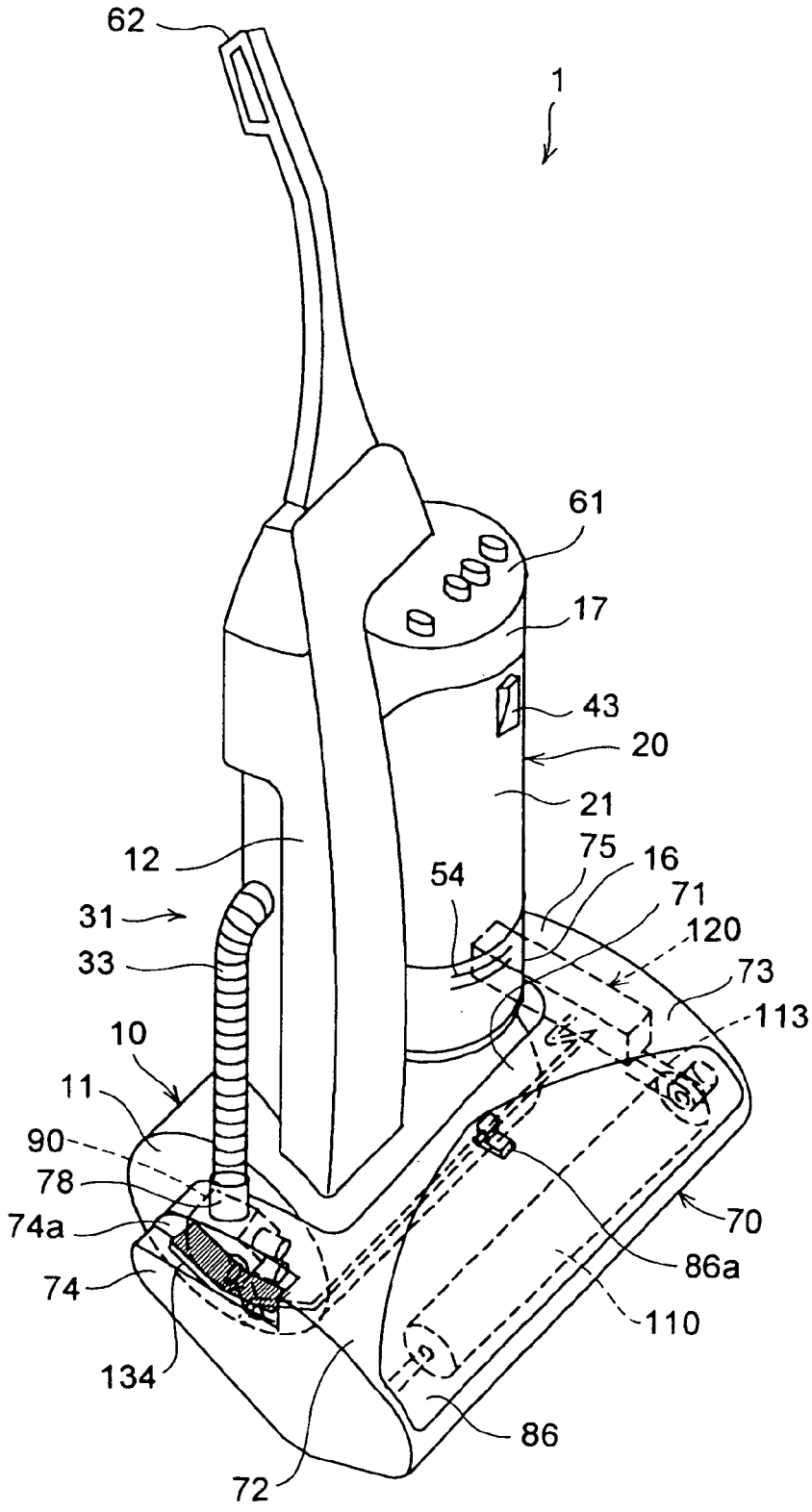
FIG. 1 is an external perspective view of the suction cleaner of a first embodiment of the invention.

Hereinafter, the construction of the suction cleaner 1 of a first embodiment of the invention will be described with reference to FIGS. 1 to 9. In the following descriptions of the construction of the suction cleaner 1, the directions are defined as follows: assuming that the suction cleaner 1 is placed in front of a user, who is thus standing behind the suction cleaner 1 so as to operate it from behind, the side of the suction cleaner 1 at which the user is standing is referred to as the rear side of the suction cleaner 1, and the side opposite thereto is referred to as the front side of the suction cleaner 1; when the suction cleaner 1 is observed from the front side thereof, the side thereof located at the same side as the observer's left hand is referred to as the left-hand side of the suction cleaner 1, and the side opposite thereto is referred to as the right-hand side of the suction cleaner 1.

The suction cleaner 1 is of an upright type, and divides roughly into two parts, namely a cleaner main unit 10 and a suction mouth unit 70. The suction mouth unit 70 is formed as a shell (for example, a molding of synthetic resin) that is structured as follows. At the center is provided a flat-box-shaped shell center piece 71, and on the left-hand and right-hand sides thereof are provided shell side pieces 72 and 73. The rear portions of the shell side pieces 72 and 73 protrude further rearward than the shell center piece 71 so as to form rearward protruding portions 74 and 75. The suction mouth unit 70 as a whole has a C-shaped horizontal section so as to receive the cleaner main unit 10 between the rearward protruding portions 74 and 75.

The cleaner main unit 10 is composed of two shell portions, namely a cylindrical blower shell 11 and a dust collecting device holder 12 that protrudes from the blower shell 11. Inside the blower shell 11 is arranged an electric blower 13 (see FIG. 2). The axial line of the electric blower 13 is substantially parallel to the axial line of the blower shell 11, and their axial lines are both substantially horizontal.

The blower shell 11 is arranged, with its axial line aligned substantially horizontally, behind the suction mouth unit 70, between the rearward protruding portion 74 and 75. The blower shell 11 has pivot shafts arranged along its axial line and fitted into the rearward protruding portions 74 and 75.

Fitted into the rearward protruding portion 74 so as to be pivoted in a bearing 76 formed therein is a pivot shaft 14 that protrudes from an end surface of the blower shell 11. Fitted into the rearward protruding portion 75 is a drive axis 15, which is an extension of the motor spindle of the electric blower 13. This drive axis 15 is enclosed in a cylindrical pivot shaft (not illustrated) that protrudes from an end surface of the blower shell 11 and that is pivoted in a bearing 77 formed in the rearward protruding portion 75. Thus, with these, i.e., left-hand and right-hand, pivot shafts, the blower shell 11 is coupled to the suction mouth unit 70 so as to be rotatable about the horizontal axial line.

The dust collecting device holder 12 is hollow, and is elongate as a whole so as to have a lengthwise direction. Its lengthwise direction is substantially perpendicular to the axial line of the blower shell 11. The dust collecting device holder 12 protrudes from the blower shell 11 not at the center thereof but at a position deviated either leftward or rightward therefrom. In the first embodiment, the dust collecting device holder 12 protrudes from a left-hand portion of the blower shell 11.

In one side face of the dust collecting device holder 12 are formed a base 16 and an overhang 17 for supporting the bottom and top, respectively, of a dust collecting device, which will be described later. The base 16 is formed as an elevation on the blower shell 11, and the overhang 17 is formed on one side of the dust collecting device holder 12. The base 16 and the overhang 17 are located above the blower shell 11, and are thus located on the right-hand side of the dust collecting device holder 12. Between the base 16 and the overhang 17 is formed a rear support wall 18 (see FIG. 3). The rear support wall 18 is formed on one side of the dust collecting device holder 12.

Figure 2:
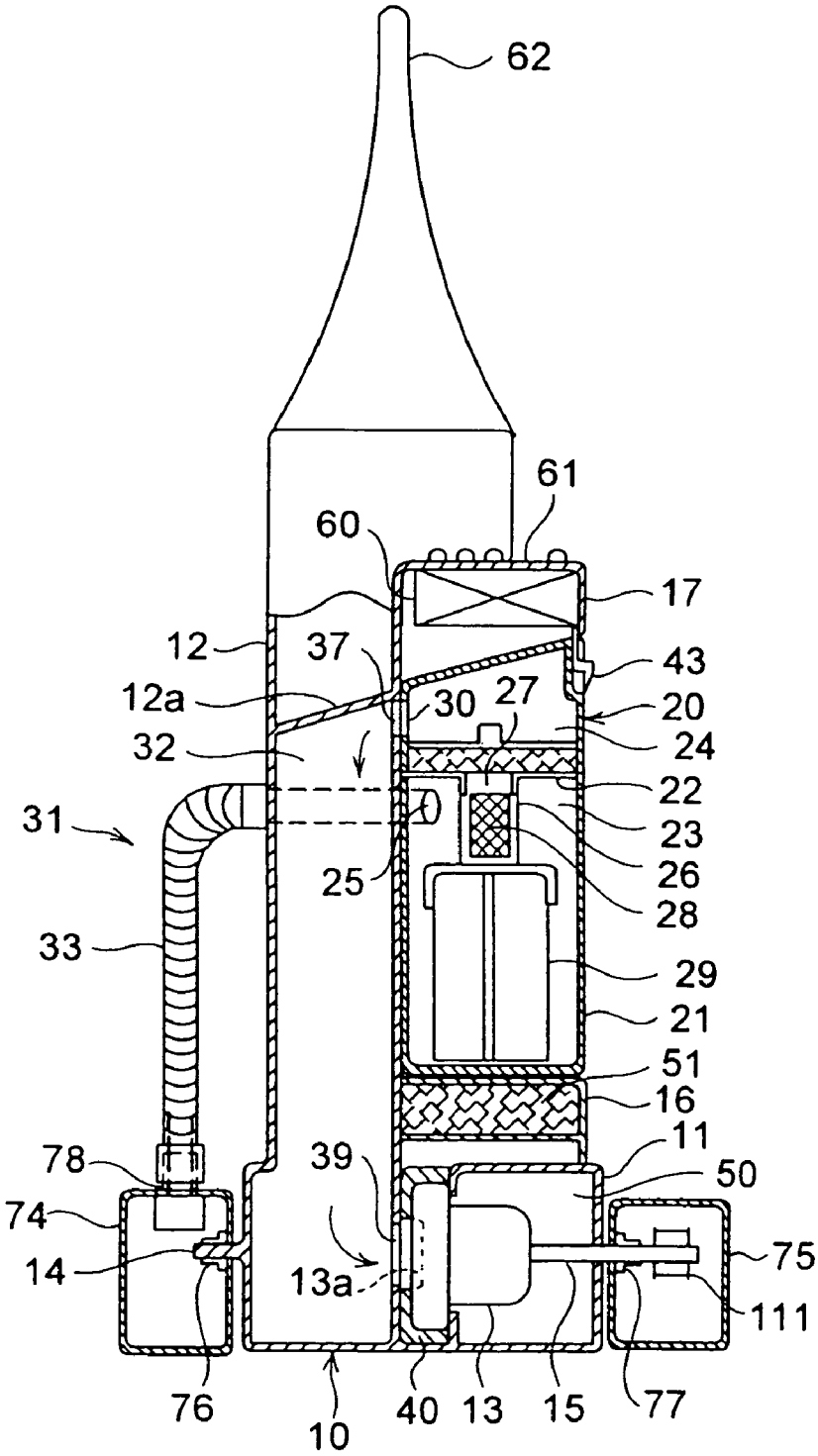
FIG. 2 is a vertical sectional view of the suction cleaner.

The dust collecting device holder 12 holds a dust collecting device 20. The dust collecting device 20 collects dust on the principle of a cyclone, i.e., by making an air stream swirl at a high speed inside an elongate cylindrical dust cup 21. As shown in FIG. 2, the interior of the dust cup 21 is divided by a horizontal partition wall 22 into two, i.e., upper and lower, sections. The lower section is a centrifugal separation chamber 23 and the upper section is an exhaust chamber 24.

The centrifugal separation chamber 23 has an inflow port 25 formed in the side surface thereof. The inflow port 25 is formed at such a position and an angle as to produce a swirling air stream along the inner circumferential wall of the centrifugal separation chamber 23.

At the center of the centrifugal separation chamber 23 is arranged an exhaust cylinder 26. The exhaust cylinder 26 is a cylindrical, basket-like member that is closed at the lower end and open at the upper end. The upper, open end of the exhaust cylinder 26 is joined to a throughflow port 27 formed at the center of the partition wall 22, so that the exhaust cylinder 26 is supported by the partition wall 22 by being suspended therefrom. Over the outer circumferential surface of the exhaust cylinder 26 is laid a filter 28 with a fine mesh woven of synthetic resin such as nylon.

At the lower end of the exhaust cylinder 26 is fitted a stabilizer 29. The stabilizer 29 is composed of four wing pieces combined radially together so as to have a cross-shaped horizontal section, and reaches, at the lower end, close to the bottom surface of the dust cup 21. The stabilizer 29 promotes the separation of dust from the air stream, and also suppresses the movement of the dust collected at the bottom of the dust cup 21.

Figure 3:
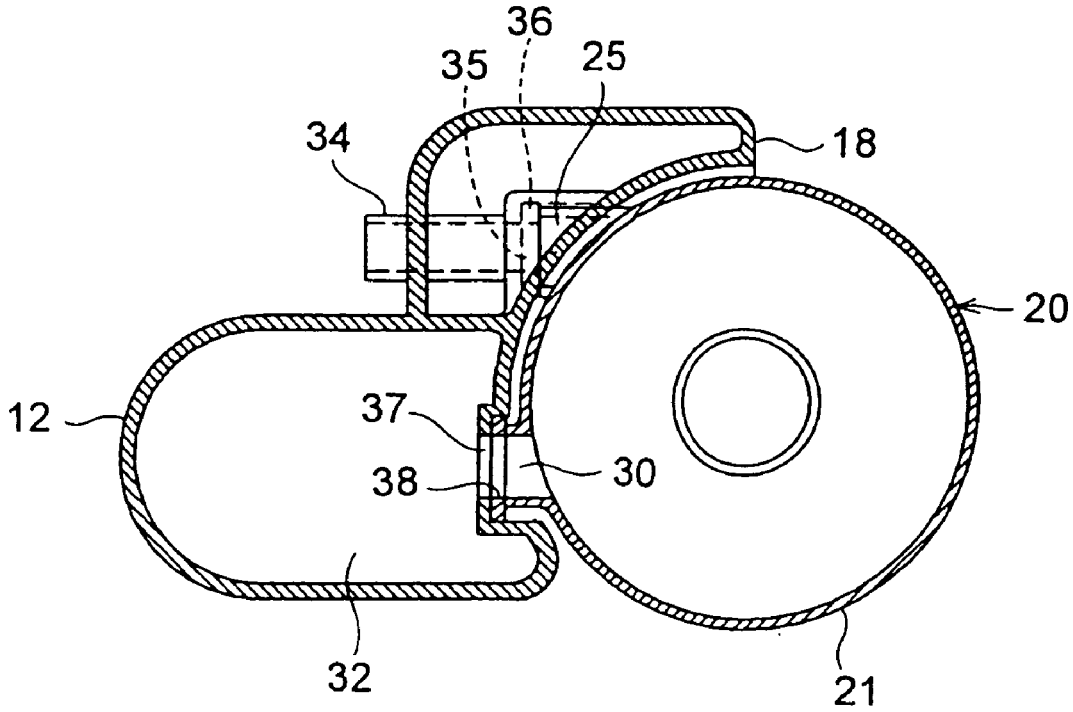
FIG. 3 is a partial horizontal sectional view of the cleaner main unit of the suction cleaner.

In the exhaust chamber 24 is formed an outflow port 30. As shown in FIG. 3, the inflow port 25 and the outflow port 30 are formed in the portion of the side surface of the dust collecting device 20 facing the dust collecting device holder 12. The inflow port 25 and the outflow port 30 point in the same direction, specifically substantially leftward.

For the inflow port 25 of the dust collecting device 20 is provided a first air passage 31, and for the outflow port 30 is provided a second air passage 32. The first air passage 31 communicates with suction mouths of the suction mouth unit 70 (which will be described in detail later) so that the air stream sucked in through a suction mouth is fed to the inflow port 25. The second air passage 32 communicates with the suction port of the electric blower 13 so that the air stream exiting from the outflow port 30 is fed to the electric blower 13.

The principal portion of the first air passage 31 is formed with a flexible hose 33. One end of the flexible hose 33 is connected to one end of a connection pipe 34 (see FIG. 3) formed horizontally on the dust collecting device holder 12. The other end of the connection pipe 34 serves as an outlet 35 of the first air passage 31, and is connected to the inflow port 25 of the dust collecting device 20. To achieve air-tight connection of the inflow port 25, the outlet 35 is fitted with a seal ring 36. The other end of the flexible hose 33 is removably fitted to a connection pipe 78 that protrudes from the upper surface of the shell side piece 72. The connection pipe 78 communicates with the suction mouths described later.

The principal portion of the first air passage 31 may be formed with any other tubular member than a flexible hose. For example, it is possible to use instead a plurality of hard pipes that are telescopically connected together. What is important here is that any tubular member can be used instead so long as it can absorb the variation of the distance between the connection pipe 34 and the connection pipe 78 between when the cleaner main unit 10 is held upright and when it is inclined, and so long as it does not collapse when the pressure inside it becomes lower than the atmospheric pressure.

The second air passage 32 is formed with the hollow space inside the dust collecting device holder 12 itself. This hollow space is, at the upper end, separated by a partition wall 12*a* (see FIG. 2), and thus the second air passage 32 does not communicate with the space around the overhang 17. In the side surface of the dust collecting device holder 12, at a position corresponding to the outflow port 30 of the dust collecting device 20, is formed an inlet 37 to the second air passage 32. To achieve air-tight connection of the outflow port 30, the inlet 37 is fitted with a seal ring 38.

As shown in FIG. 2, the lower end of the second air passage 32 reaches the bottom of the blower shell 11. In the side wall at the lower end of the second air passage 32 is formed an outlet 39. To the outlet 39 is directly connected the suction port 13a of the electric blower 13 with an anti-vibration cushion 40 interposed therebetween that also serves to achieve air-tight connection.

The dust collecting device 20 is fitted to the dust collecting device holder 12 by being pressed onto it with the lengthwise direction of the former aligned with the lengthwise direction of the latter. More specifically, the dust collecting device 20 is fitted into position by being inserted into the space surrounded by the base 16, the overhang 17, and the rear support wall 18.

At the upper end of the right-hand side surface of the dust collecting device 20 is fitted a slide-type latch 43. The latch 43 is kept pressed upward by an unillustrated spring, and engages with the rim of the overhang 17 at the last stage of the insertion of the dust collecting device 20. In this state, the dust collecting device 20 cannot be removed from the dust collecting device holder 12 unless the latch 43 is pressed down against the unillustrated spring so as to be released from the overhang 17.

The interior of the base 16 communicates with an exhaust space 50 into which the electric blower 13 discharges air. In an upper portion of a filter chamber 46 is inserted a filter 51. The filter 51 is for collecting fine dust that has passed through the filter 28 of the dust collecting device 20, and is realized with a filter, for example a HEPA (high-efficiency particular air) filter, that has higher filtering performance than the filter 28.

The air stream having been removed dust therefrom by the filter 51 flows back into the room through an exhaust port 54 (see FIG. 2) formed in the front surface of the base 16. The exhaust port 54 has a plurality of horizontal slits lined in the vertical direction.

Inside the overhang 17 is arranged a controller 60 (see FIG. 2). The controller 60 is connected to the electric blower 13 by leads. The controller 60 controls the entire suction cleaner 1. The front portion of the upper surface of the overhang 17 is formed into an operation panel 61 having various switch buttons arranged thereon. Arranging the operation panel 61 on the overhang 17 offers easy operation.

At the top end of the dust collecting device holder 12 is fixed a separately formed handle 62. Obliquely downward from a rear portion of the lower surface of the blower shell 11 protrude brackets 63, to which are fitted wheels 64 (see FIG. 4). The wheels 64 are provided one at each of the left-hand and right-hand ends of the blower shell 11. In front of the wheels 64 are formed support feet 65, one on the left and one on the right. When the dust collecting device holder 12 is held upright, the cleaner main unit 10 is supported on the floor at four points by the wheels 64 and the support feet 65.

Next, the construction of the suction mouth unit 70 will be described. As described earlier, the suction mouth unit 70 has a shell center piece 71 and shell side pieces 72 and 73 arranged on the left-hand and right-hand sides thereof, with the rear portions of the shell side pieces 72 and 73 formed into rearward protruding portions 74 and 75. The shell center piece 71 and the shell side pieces 72 and 73 are formed integrally, for example, by molding synthetic resin.

Figure 4:
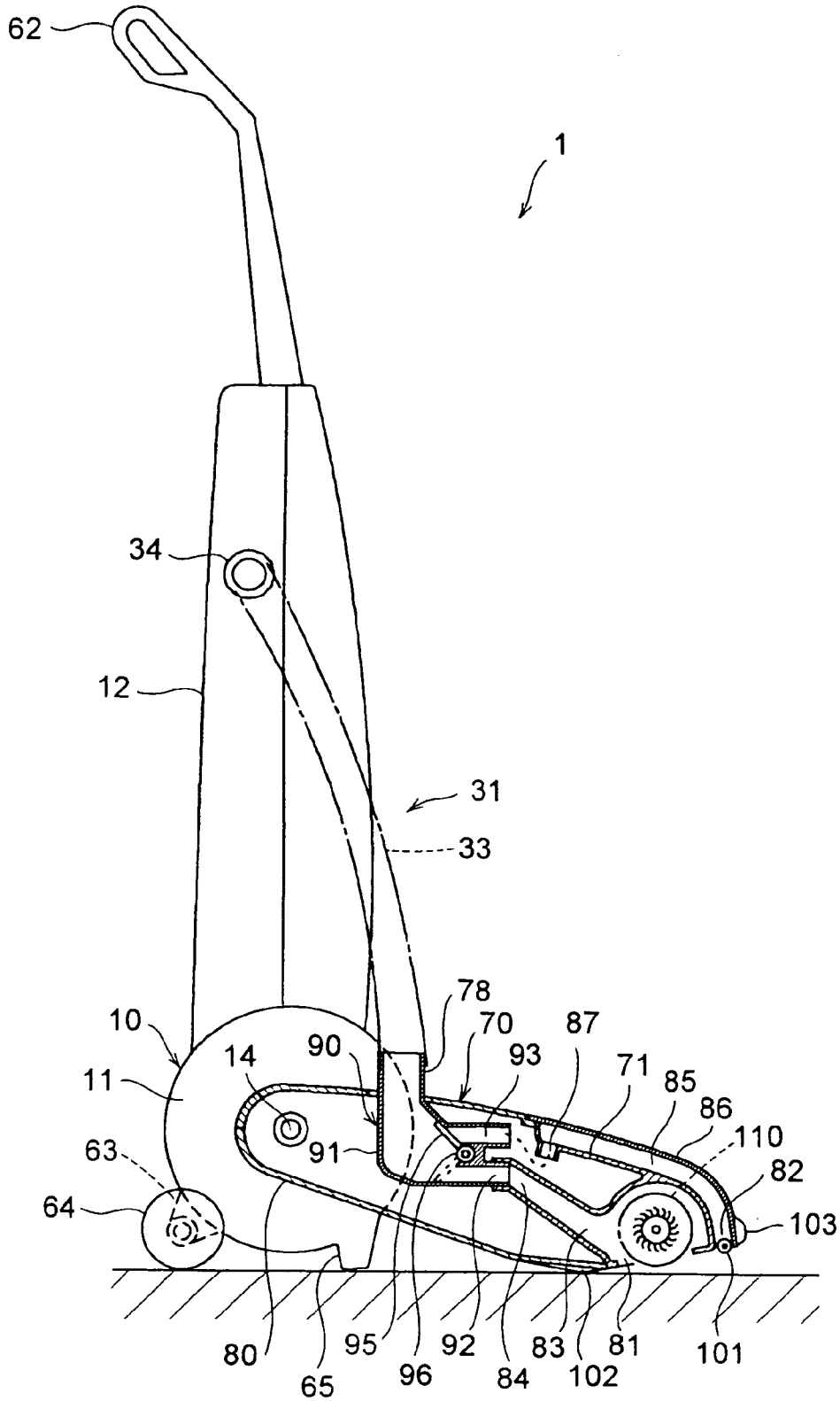
FIG. 4 is a side view of the suction cleaner, with the suction mouth unit shown in a section thereof.
Figure 5:
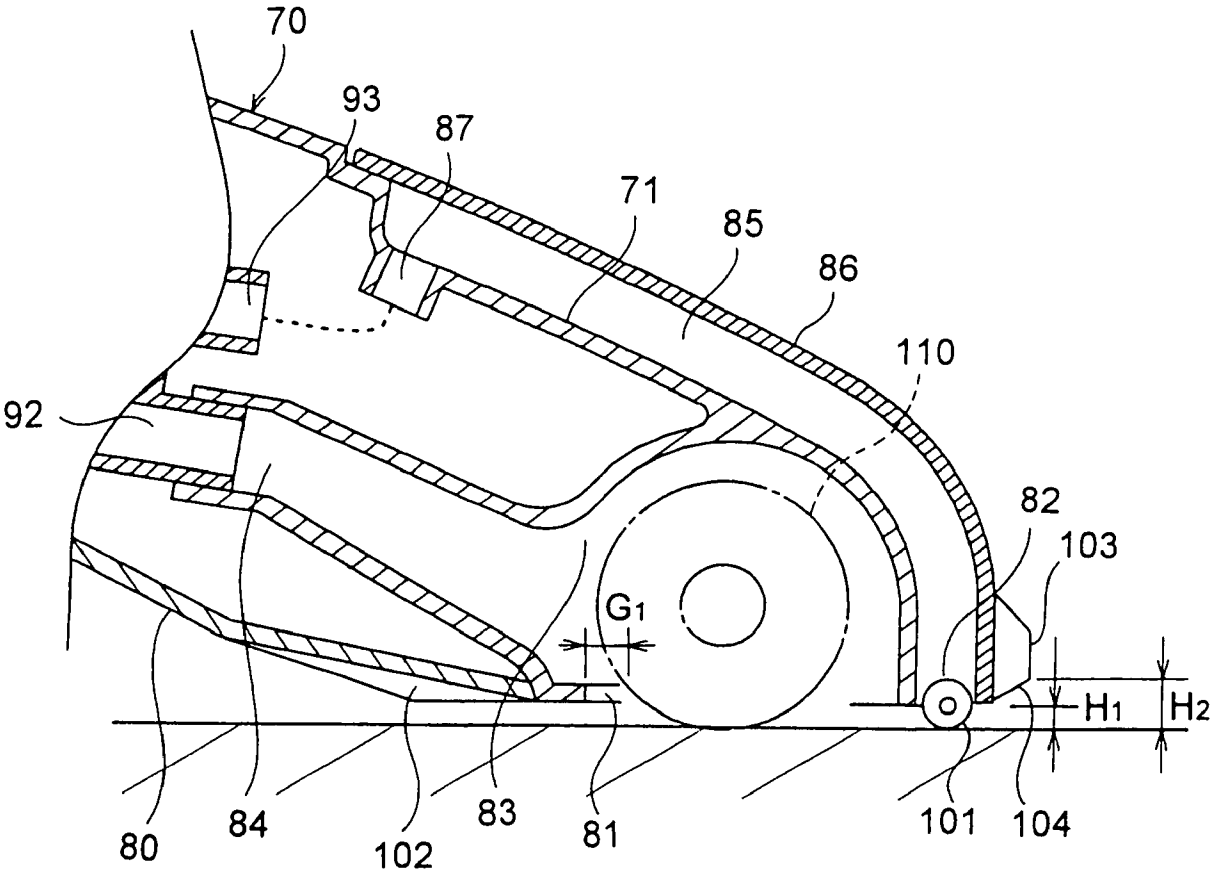
FIG. 5 is a partly enlarged sectional view of the suction mouth unit, showing it in a state different from that shown in FIG. 4.

The shell center piece 71 and the shell side pieces 72 and 73 have an opening at the bottom, and this opening is shut by a bottom plate 80 (see FIGS. 4 and 5). In the front portion 80*a* of the bottom plate 80 are formed a plurality of suction mouths. The rear portion of the bottom plate 80 is slanted so as to be increasingly higher rearward.

In the first embodiment, in the front portion 80*a* of the bottom plate 80 are formed two suction mouths, one in front of the other. The first suction mouth 81 is elongate in the left/right direction, and has a width nearly equal to the width of the suction mouth unit 70 excluding the later-described belt drive. The second suction mouth 82 is formed parallel to and in front of the first suction mouth 81. The opening area of the second suction mouth 82 is far smaller than the opening area of the first suction mouth 81.

For each of the first and second suction mouths 81 and 82, an independent suction passage is provided. The suction passage 83 for the first suction mouth 81 is formed on the lower surface of the shell center piece 71 (see FIG. 4). The suction passage 83 has a funnel-like shape, and has an outflow port 84 formed at a position deviated leftward as seen from the front.

The suction passage 85 for the second suction mouth 82 is arranged above the suction passage 83 so as to overlap it. The suction passage 85 is formed between the upper surface of the shell center piece 71 and a lid 86 that is removably fitted at a distance therefrom. The lid 86 is fitted with the front edge thereof engaged with the shell center piece 71 and the rear edge thereof fastened to the shell center piece 71 with a screw or a latch 86*a*. The lid 86 is formed out of a transparent or semitransparent material so that the interior of the suction passage 85 can be observed from outside. The suction passage 85 has an outflow port 87 near the center of the rear portion of the suction passage 85.

Inside the rearward protruding portion 74 of the shell side piece 72 is arranged a suction mouth switching device 90. The suction mouth switching device 90 has a valve case 91 having two, i.e., an upper and a lower, inflow ports 92 and 93 formed in the front surface thereof. The lower inflow port 92 is connected to the outflow port 84 of the suction passage 83. As shown in FIG. 4, coupling the outflow port 84 directly to the inflow port 92 helps simplify the passage structure of the air stream, and thus helps increase air passage efficiency. The upper inflow port 93 is connected, through an unillustrated hose, to the outflow port 87 of the suction passage 85.

In the upper surface of the valve case 91 is formed an outflow port that is shared between the inflow ports 92 and 93. In the first embodiment, this outflow port itself forms the connection pipe 78 that serves as the starting point of the first air passage 31.

In the valve case 91 is arranged a switch valve 95 that rotates in a vertical plane. The switch valve 95 is fitted on a valve shaft 96 so as to rotate together. The switch valve 95 so rotates as to selectively close one of the inflow ports 92 and 93 and open the other. The details of the construction of the suction mouth switching device 90 will be described later. On both sides of the switch valve 95 are fitted sealing members (not illustrated) molded out of soft rubber or the like for achieving air-tight closure of the inflow ports 92 and 93.

On the bottom surface of the suction mouth unit 70 are formed a first and a second bottom support. The first bottom support 101 is realized with wheels provided near the second suction mouth 82, in this case at both ends of the second suction mouth 82.

The second bottom support 102 is realized with a pair of, i.e., a left-hand and a right-hand, projections formed on the bottom plate 80. The second bottom support 102 is formed behind the first suction mouth 81. This position is where the inclination of the rear portion of the bottom plate 80 starts. When the dust collecting device holder 12 is held upright, as shown in FIG. 4, the second bottom support 102 supports the suction mouth unit 70, while the first bottom support 101 stays off the floor.

From the front end of the suction mouth unit 70 protrudes a guide 103. The guide 103 is located in front of the second suction mouth 82, and has a width nearly equal to the total width of the suction mouth unit 70. The lower surface of the guide 103 is a slanted surface 104 that is increasingly lowered toward the second suction mouth 82 (see FIG. 5). The front end of the slanted surface 104 is about 3 mm higher than the entrance of the second suction mouth 82.

In the first suction mouth 81 is provided an agitator 110. A typical example of the agitator 110 is one composed of a cylindrical rotary member having bristles planted around it forming a plurality of rows arranged at a predetermined skew angle. Instead of rows of bristles, blades of rubber or soft synthetic resin may be used. The agitator 110 has its axial line aligned with the width direction of the first suction mouth 81, and is pivoted inside the suction mouth unit 70 with part of the outer circumferential portion of the agitator 110 protruding out of the first suction mouth 81.

The motive power that drives the agitator 110 to rotate is derived from the drive axis 15 of the electric blower 13. From there, the motive power is transmitted to the agitator 110 by way of the following motive power transmission mechanism. As shown in FIG. 2, to the drive axis 15 is fixed a source pulley 111, and on this source pulley 111 and on a drive pulley (described later) fixed to the shaft of the agitator 110 so as to rotate together with the agitator 110 is wound by a belt 113. The source pulley 111 and the belt 113 are located inside the shell side piece 73. Instead of fixing a separate source pulley 111 to the drive axis 15, the belt 113 may be wound directly on the drive axis 15.

To permit the rotation of the agitator 110 to be stopped while the electric blower 13 is operating, an idler that can rotate independently of the agitator is arranged by the side of the drive pulley. When the belt 113 is wound on the idler, simply the idler rotates idly, and no motive power is transmitted to the agitator 110. A belt shifting device 120 for shifting the belt 113 is provided inside the shell side piece 73. Its construction will be described in detail later.

Figure 6:
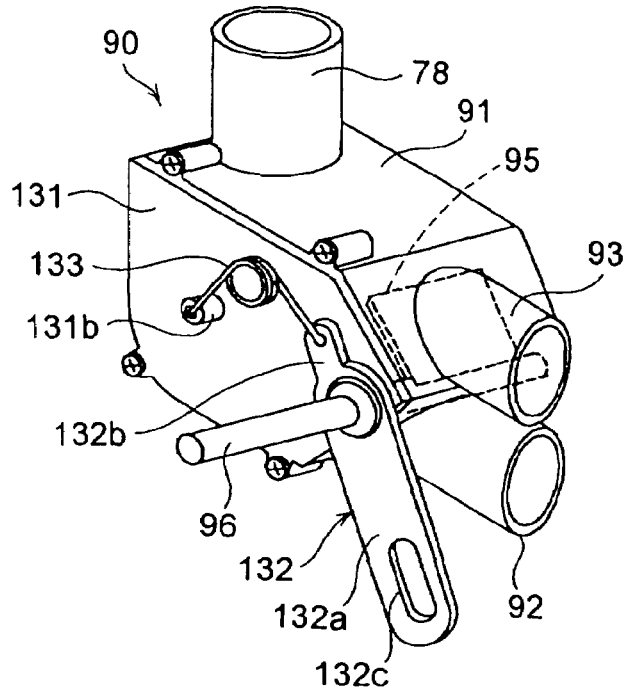
FIG. 6 is a perspective view of the suction mouth switching device.
Figure 7:
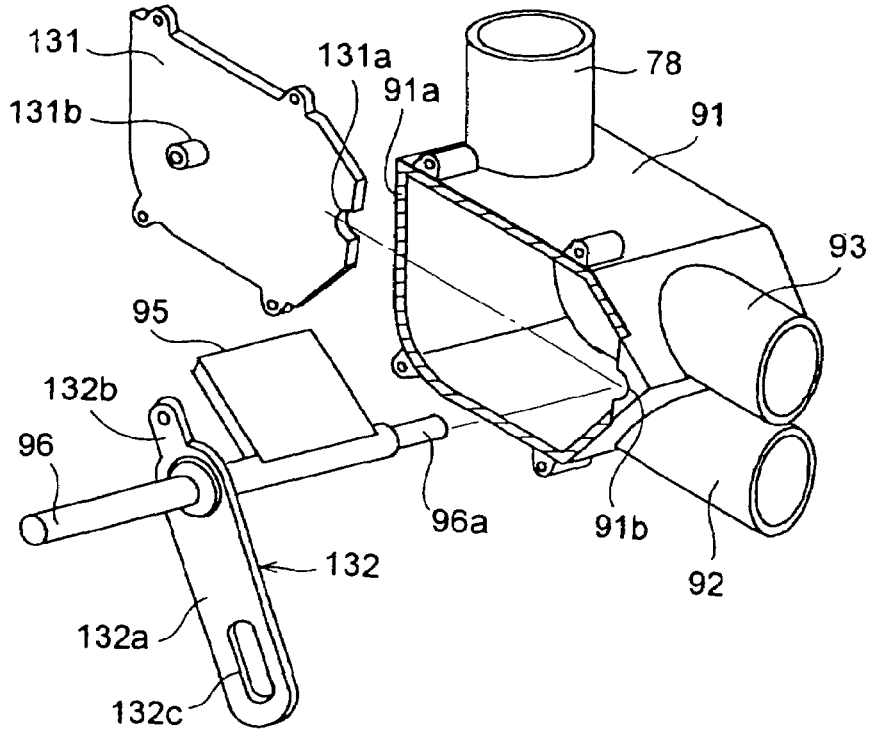
FIG. 7 is an exploded perspective view of the suction mouth switching device.

Next, with reference to FIGS. 6 and 7, the construction of the suction mouth switching device 90 will be described in detail. The valve case 91 of the suction mouth switching device 90 is open at the left-hand side face thereof, and this opening is shut by a lid 131. The lid 131 is fixed to the valve case 91 with screws. To achieve airtight closure, around the rim of the opening of the valve case 91 is fitted a sealing member 91*a*.

Formed integrally with the valve shaft 96 are the switch valve 95 and a lever 132. The valve shaft 96, the switch valve 95, and the lever 132 are integrally formed of synthetic resin or metal by injection molding or the like, or by firmly uniting an assembly of separately molded parts.

The right-hand end of the valve shaft 96 is formed into a small-diameter portion 96*a*, and this portion protrudes from the valve case 91 rightward through a shaft hole (not illustrated) formed therein. The left-hand portion of the small-diameter portion 96*a* is pivoted by being sandwiched between a groove 91*b* with a semicircular cross-section formed in the inner surface of the valve case 91 and a semicircular cut 131*a* formed in the lid 131. That is, the groove 91*b* and the semicircular cut 131*a* together constitute a bearing. The groove 91*b* is located between the inflow ports 92 and 93, and is located on the upstream side of the air stream inside the valve case 91. Arranging it on the upstream side of the air stream helps prevent dust from clinging to the valve shaft 96 and thereby hindering the movement of the switch valve 95.

On the valve shaft 96, just outside the semicircular cut 131*a*, the lever 132 is integrally formed. The lever 132 is a component belonging to a coordinating means for coordinating the operation of the suction mouth switching device 90 with the operation of the belt shifting device 120. To permit the valve shaft 96 to be formed integrally with not only the switch valve 95 but also the lever 132, the valve shaft 96 is formed out of a material having necessary strength, such as an engendering plastic grade synthetic resin or metal.

The lever 132 is so shaped as to have two, i.e., a long and a short, arms 132*a* and 132*b* protruding from the valve shaft 96 in opposite directions. At the tip end of the longer arm 132*a* is formed a slit 132*c*. The length direction of the slit 132*c* coincides with the length direction of the longer arm 132*a*. Between the shorter arm 132*b* and the lid 131 is arranged a toggle spring 133.

The toggle spring 133 is a pigtail-shaped coil spring, and has one end thereof engaged with the tip of the shorter arm 132*b* and the other end thereof with a hollow boss 131*b* formed on the outer surface of the lid 131. The toggle spring 133 is at its vacillating point when the valve shaft 96 is at such an angle that the shorter arm 132*b* and the hollow boss 131*b* are closest together, and, according to on which side of the vacillating point the toggle spring 133 is, it loads the switch valve 95 with either a force that tends to close the inflow port 92 or a force that tends to close the inflow port 93.

At the left-hand end of the valve shaft 96 is fitted a pedal 134 (see FIG. 1) for switching the switch valve 95. The pedal 134 is arranged in a recess 74*a* formed in an upper left-hand corner of the rearward protruding portion 74 of the suction mouth unit 70. The pedal 134 is divided, at its center at which it is fitted to the valve shaft 96, into a front and a rear portion that are at an angle relative to each other so as to have a V-shaped cross-section as seen from the side. By stepping on whichever of the front and rear portions of the pedal 134 is held up, the pedal 134 works like a see-saw to rotate the valve shaft 96.

Figure 8:
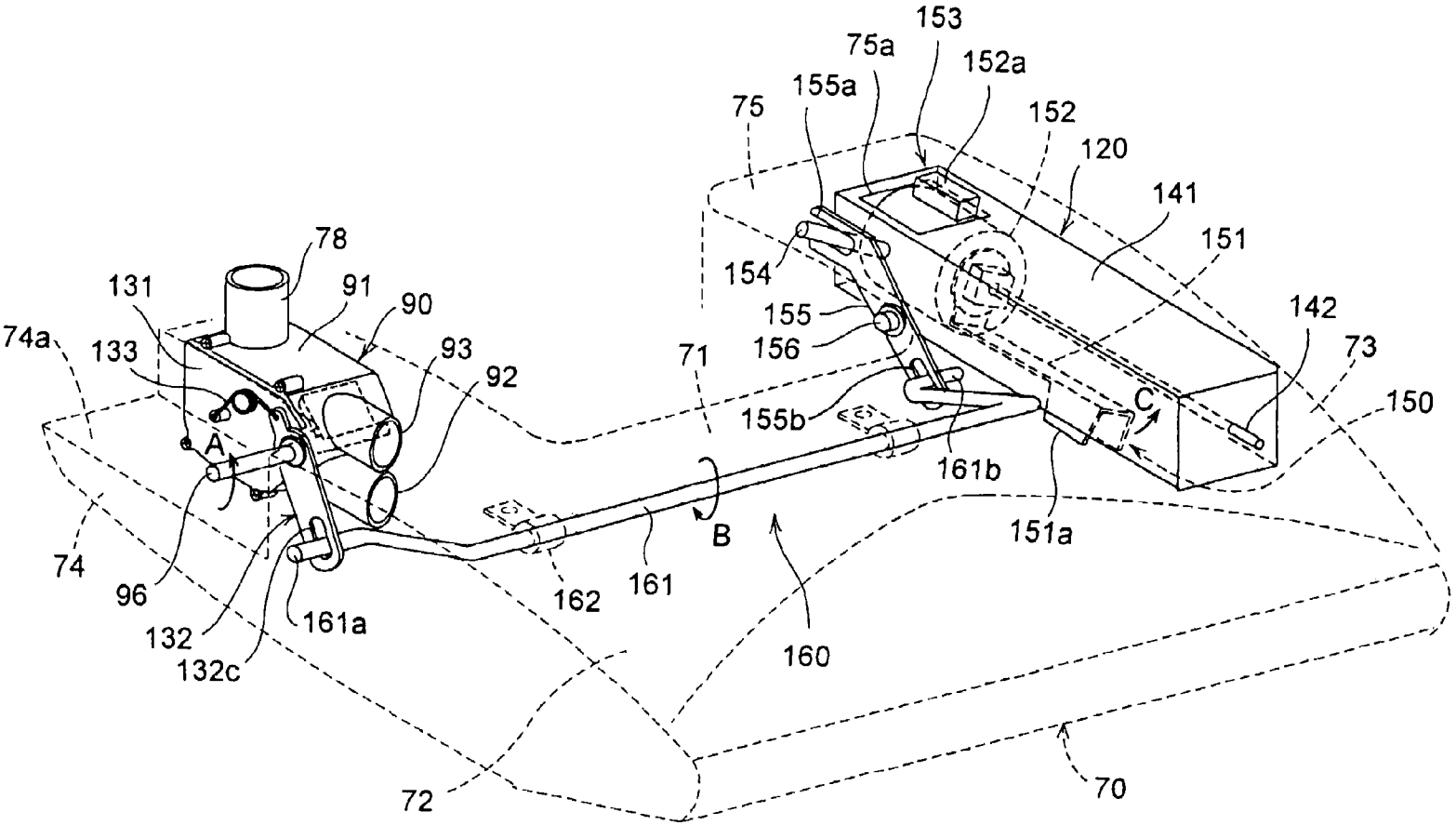
FIG. 8 is a perspective view of the internal mechanism of the suction mouth unit.
Figure 9:
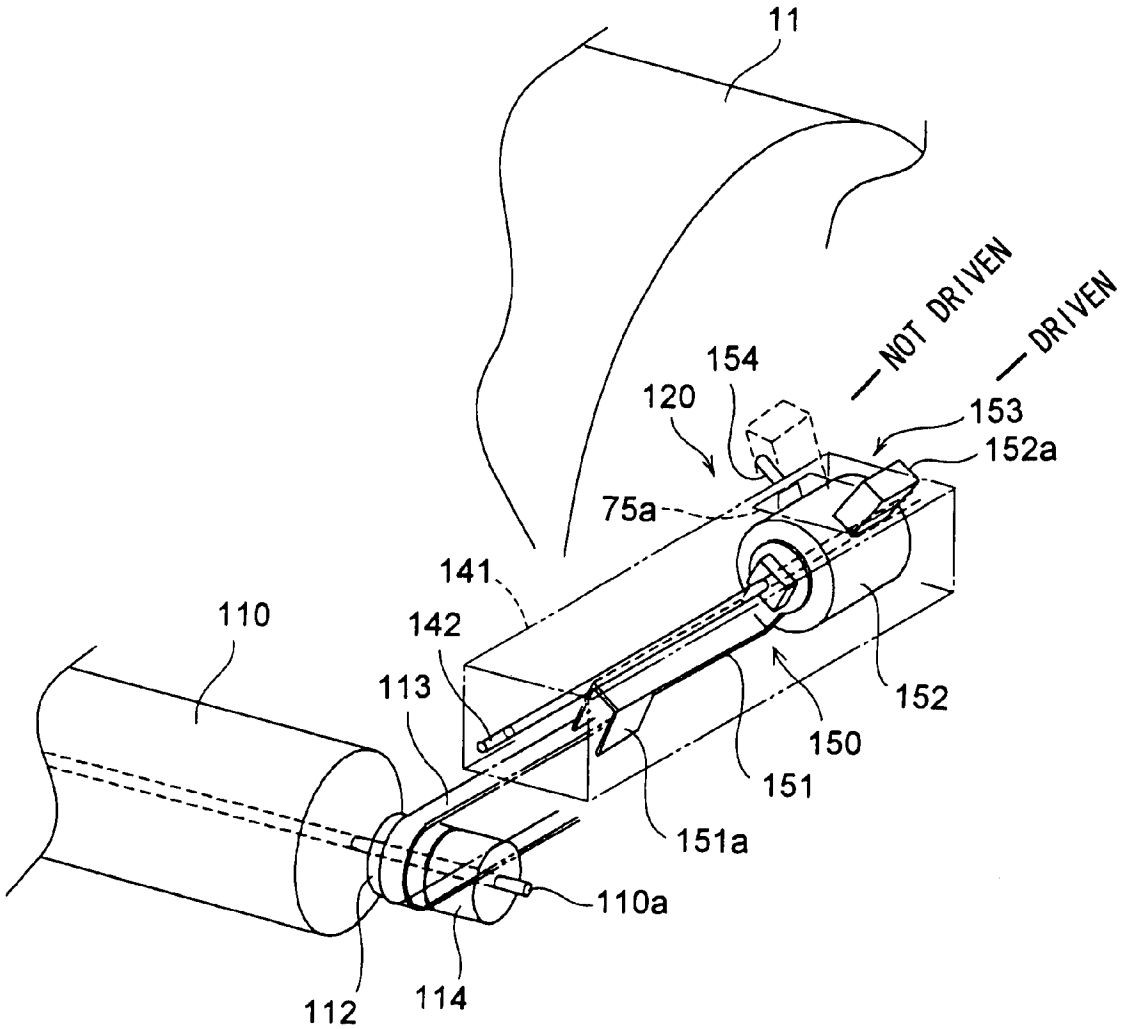
FIG. 9 is a perspective view of the internal mechanism of the suction mouth unit, showing it as seen from a different direction as compared with FIG. 8.

Next, with reference to FIGS. 8 and 9, the construction of the belt shifting device 120 will be described in detail. The belt shifting device 120 is built around an elongate frame 141. The frame 141 is fixed, with its length direction aligned with the front/rear direction of the suction mouth unit 70, inside the shell side piece 73. Below the frame 141 runs the belt 113. The belt 113 is switched between a state wound on a drive pulley 112 and a state wound on an idler 114. The drive pulley 112 is fixed to the shaft 110*a* of the agitator 110 so as to rotate together with the agitator 110. The idler 114 is located on the right side of the drive pulley 112, and can rotate independently of the agitator 110.

The frame 141 supports a shaft 142 that extends in the front/rear direction. The axial line of the shaft 142 is parallel to the extension line of the belt 113. The shaft 142 rotatably supports a fork 150 for shifting the belt 113. The fork 150 is composed of a main member 151, which is formed out of metal, and a pivot portion 152, which is formed out of synthetic resin, assembled together nonrotatably relative to each other. The main member 151 and the pivot portion 152 of the fork 150 are fixed together by insert molding, screw-fastening, or by swaging. Since the pivot portion 152 is formed out of a synthetic resin, when it rotates relative to the shaft 142, it does not make much noise.

The main member 151 of the fork 150 protrudes frontward from the pivot portion 152, with the length direction of the main member 151 parallel to the shaft 142 and to the extension direction of the belt 113. The main member 151 has, at the tip thereof, a pair of parallel walls 151*a*, between which the main member 151 holds the belt 113. The parallel walls 151*a* extend parallel to the main member 151, and are parallel to each other. The parallel walls 151*a* are located a predetermined distance or more away from the pivot portion 152.

In an upper portion of the pivot portion 152 is formed a knob-shaped operation portion 152*a*. The operation portion 152*a* protrudes out of the rearward protruding portion 75 of the suction mouth unit 70 through a window 75*a* formed therein. The pivot portion 152 is rotatable between a limit provided at where the operation portion 152*a* hits the stopper provided at one end of the window 75*a* and a limit provided at where the operation portion 152*a* hits the stopper provided at the other end of the window 75*a*. That is, the operation portion 152*a* and the window 75*a* together constitute a stopping means 153 for setting the limits of rotation of the fork 150. The stoppers provided at the window 75*a* may be realized by the operation portion 152*a* hitting the shell side piece 73 or the frame 141.

Between the pivot portion 152 and the frame 141 is arranged an unillustrated toggle spring. This toggle spring also is a pigtail-shaped coil spring, and has one end thereof engaged with the pivot portion 152 and the other end thereof with the frame 141 to permit the pivot portion 152 to be crisply switched between different angles.

Radially from the left-hand side surface of the pivot portion 152 protrudes a lever 154. On the left-hand side surface of the frame 141, a lever 155 is supported by a shaft 156 so as to be rotatable in a vertical plane. A slit 155*a* formed in one arm of the lever 155 engages with the lever 154. The other arm of the lever 155 also has a slit 155*b*. The length direction of the slits 155*a* and 155*b* coincides with the direction in which the lever 155 itself extends.

The suction mouth switching device 90 and the belt shifting device 120 are coupled together by a coordinating means 160. The coordinating means 160 is built around a crank 161 formed by bending a bar or pipe of steel substantially into a C-like shape. The crank 161 is pivoted inside the suction mouth unit 70 by a pair of, a left-hand and a right-hand, bearings 162 so as to be rotatable about a horizontal axis. One end 161*a* of the crank 161 engages with the slit 132*c* of the lever 132 provided on the part of the suction mouth switching device 90. The other end 161*b* of the crank 161 engages with the slit 155*b* of the lever 155 provided on the part of the belt shifting device 120. Like the lever 132, the lever 155 also is a component belonging to the coordinating means 160.

As described above, the cleaner main unit 10 is fitted into the C-shaped suction mouth unit 70, with the suction mouth switching device 90 arranged in one side of the suction mouth unit 70 and the belt shifting device 120 in the other side. This permits a certain part of the suction mouth switching device 90 and a certain part of the belt shifting device 120 to be so arranged as to overlap each other, and thus helps reduce the dimensions of the suction mouth unit 70, in particular its dimension in the front/rear direction.

Next, the operation of the suction cleaner 1 will be described. When the suction cleaner 1 is not in use, i.e., when it is stored away, the dust collecting device holder 12 stands upright, and the cleaner main unit 10 sits on the floor by being supported at four points by the two wheels 64 and the two support feet 65. In the suction mouth unit 70, the second bottom support 102 supports the suction mouth unit 70, while the first bottom support 101 stays off the floor. Also off the floor stays the agitator 110.

Figure 15:
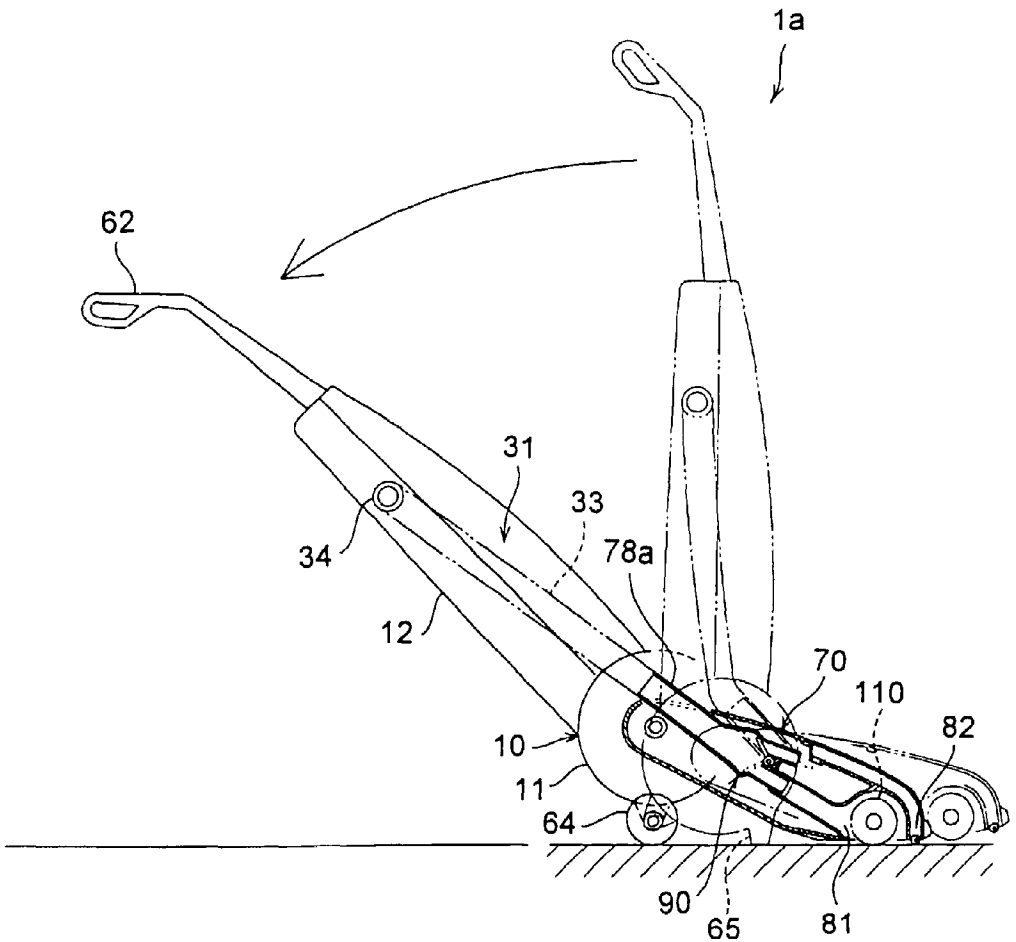
FIG. 15 is a side view, like FIG. 4, of a fourth embodiment of the invention.

When the suction cleaner 1 is used, an unillustrated power cord is extended and is connected to a power outlet, and, with the handle 62 held in one hand, the dust collecting device holder 12 is tilted as shown in FIG. 15. This brings the suction cleaner 1 into a cleaning operation posture. Now, the cleaner main unit 10 acts on the principle of a lever. Specifically, the handle 62 serves as the point of effort of a lever, the wheels 64 as the fulcrum thereof, and the pivot shaft 14 and the drive axis 15 (the cylindrical pivot shaft outside the drive axis 15) as the point of action thereof, with the result that the pivot shaft 14 and the drive axis 15 (the cylindrical pivot shaft outside the drive axis 15) lift up the rear portion of the suction mouth unit 70. The support feet 65 move off the floor.

When the cleaner main unit 10 is tilted until the height of the handle 62 from the floor is about 60 to 80 cm, the second bottom support 102 moves off the floor, and the front portion 80*a* of the bottom plate 80, where the first and second suction mouths 81 and 82 are formed, becomes nearly parallel to the floor. Thus, the first bottom support 101 and the agitator 110 make contact with the floor (see FIG. 5). The height of 60 to 80 cm is the height at which the handle 62 is located when an adult of average height moves the suction cleaner 1 back and forth to perform cleaning.

The degree of protrusion of the first bottom support 101 is so set that, in this state, the height ($H_1$ in FIG. 5) of the entrance of the second suction mouth 82 from the floor is 0.8 mm to 2 mm. Thus, the second suction mouth 82 can come so close to the floor as to be at that distance (0.8 mm to 2 mm) therefrom, but then the first bottom support 101 makes contact with the floor and thereby prevents the second suction mouth 82 from coming closer.

Now, a predetermined switch on the operation panel 61 is operated to drive the electric blower 13. The electric blower 13 produces a suction pressure that reaches the suction mouth unit 70 through the suction port 13*a*, the second air passage 32, the dust collecting device 20, and the first air passage 31.

If the suction mouth switching device 90 is in the state in which it selects the first suction mouth 81, an air stream is sucked in through the first suction mouth 81. If the suction mouth switching device 90 is in the state in which it selects the second suction mouth 82, an air stream is sucked in through the second suction mouth 82. When the first suction mouth 81 is selected, the belt shifting device 120 winds the belt 113 on the drive pulley 112. Accordingly, as the electric blower 13 is driven, the agitator 110 is driven.

The following description assumes that the suction mouth switching device 90 selects the first suction mouth 81. When rotating, the agitator 110 rakes dust off the floor or the covering laid thereon. When the agitator 110 is rotated on a soft flooring material (for example, a carpet with 4 mm to 20 mm long pile), the first bottom support 101 sinks into the soft flooring material. This permits the agitator 110 and the first suction mouth 81 to come close to the soft flooring material, resulting in powerful raking-off of dust and powerful suction. By setting a limit to the width of the first bottom support 101 as seen from the front (for example, by making the total width of the first bottom support 101 as seen from the front equal to or smaller than the width of the first suction mouth 81, or by making the width of each part of the first bottom support 101 equal to 10 mm to 20 mm), it is possible to ensure that the 101 sinks into the soft flooring material.

As described above, on a carpet, the first bottom support 101 sinks into the pile of the carpet, and the front portion 80*a* of the bottom plate 80 supports the suction mouth unit 70. This helps obtain satisfactory operability on a carpet. By making the gap ($G_1$ in FIG. 5) between the outer circumference of the agitator 110 and the rear edge of the first suction mouth 81 equal to 5 mm to 10 mm, it is possible to obtain satisfactory operability and satisfactory suction performance simultaneously.

Moreover, the height ($H_2$ in FIG. 5) from the floor to the lower front edge of the guide 103 is about 3 mm (which may be about 3 mm to 4.5 mm) greater than the height ($H_1$ in FIG. 5) from the floor to the entrance of the second suction mouth 82. Thus, even with the front portion of the bottom plate 80 kept in contact with the carpet, the guide 103 does not push around dust on the carpet. The guide 103 rides over a piece of dust, if it has the size of a rice grain, and invites it into the first suction mouth 81. To obtain satisfactory dust riding-over performance, the slanted surface 104 is advisably given an inclination not larger than 40° to 50° relative to the horizontal plane.

The dust raked off by the agitator 110, along with the air stream that flows in through the first suction mouth 81, flows through the inflow port 92 into the suction mouth switching device 90, and then flows out of the suction mouth switching device 90 through the connection pipe 78 into the first air passage 31. Having passed through the first air passage 31, the air stream flows through the inflow port 25 of the dust collecting device 20 into the centrifugal separation chamber 23.

The air stream that has flowed in through the inflow port 25 swirls at a high speed around the exhaust cylinder 26. The dust contained in the air stream is separated from the air stream by centrifugal force and accumulate at the bottom of the dust cup 21. The swirling air stream having been removed dust therefrom is sucked into the exhaust cylinder 26, and then flows into the exhaust chamber 24. The dust that has not been separated by centrifugal force is filtered out by the filter 28. The air stream that has flowed into the exhaust chamber 24 flows out of it through the outflow port 30.

The air stream that swirls inside the centrifugal separation chamber 23 swirls not only around the exhaust cylinder 26 but also around the stabilizer 29. Meanwhile, when the air stream collides with the wing pieces of the stabilizer 29, the dust contained in the air stream separates therefrom and drops onto the bottom of the dust cup 21. As the suction of dust is continued, a lump of dust grows from the bottom of the dust cup 21. The stabilizer 29 suppresses the movement of this lump of dust so as to prevent dust from being blown up back into the air.

The air stream that has exited from the dust collecting device 20 flows into the second air passage 32. The second air passage 32 runs substantially along a straight line until it finally connects to the suction port 13*a* of the electric blower 13, and thus the air stream flows therethrough straight to the suction port 13*a* without being obstructed or intercepted in any way. Since the second air passage 32 is formed by the hollow space inside the dust collecting device holder 12 itself, it has a large cross-sectional area. This helps increase the flow efficiency of the air stream.

The air stream sucked into the electric blower 13 is discharged into the exhaust space 50, and then flows into the base 16. Fine dust that has not been filtered out by the filter 28 is filtered out by the filter 51. Thereafter, the air stream is exhausted through the exhaust port 54.

While the electric blower 13 is driven, the belt 113 runs. It is impossible to completely prevent the running belt 113 from touching the fork 150. Fortunately, however, what the belt 113 touches is the parallel walls 151*a* of the main member 151, which is formed out of metal. Thus, although the main member 151 cannot be prevented from becoming hot due to frictional heat, it, unlike a molding of synthetic resin, can be prevented from being damaged due to overheating; it is also resistant to friction. Moreover, since the parallel walls 151*a* are located a predetermined distance or more away from the pivot portion 152, the portion of the main member 151 located between the parallel walls 151*a* and the pivot portion 152 dissipates heat, and thereby prevents too much frictional heat from conducting from the parallel walls 151*a* to the pivot portion 152.

When cleaning is performed in a corner of a room, the pedal 134 is operated to switch the suction mouth switching device 90 to the second suction mouth 82. That is, whereas up to now the switch valve 95 has kept the inflow port 92 open and the inflow port 93 closed, it now makes the inflow port 93 open and the inflow port 92 closed. At this time, the valve shaft 96 rotates counter-clockwise (in the direction indicated by arrow A) as seen in FIG. 8. Then, the lever 132 lifts up the end 161*a* of the crank 161, and the crank 161 as a whole rotates clockwise (in the direction indicated by arrow B) in the bearings 162. This movement causes the other end 161*b* of the crank 161 to lift up the front portion of the lever 155. Accordingly, the rear portion of the lever 155 moves down and presses down the lever 154. As a result, the fork 150 rotates about the axial line of the shaft 142. The direction of this rotation is counter-clockwise (in the direction indicated by arrow C) as seen from the front.

When the fork 150 rotates counter-clockwise as seen from the front, the parallel walls 151*a* moves from left to right describing an arc of which the radius is equal to the distance from the center of the pivot shaft 121. This movement causes the belt 113 to be shifted from the state wound on the drive pulley 112 to the state wound on the idler 114. The fork 150 rotates about an axial line parallel to the extension line of the belt 113, and thus the swing is not amplified at the parallel walls 151*a* located at the tip. This keeps the belt 113 running stably. Moreover, the stopping means 153 sets the limits of rotation of the fork 150. This keeps the belt 113 neatly in a predetermined position.

Moreover, no matter how much the pivot portion 152 is rotated, the parallel walls 151*a* are kept parallel to the extension line of the belt 113. This minimizes deformation (twisting, bending) of the belt 113. This means that the parallel walls 151*a* themselves are less likely to be damaged by the belt 113 and vice versa.

In a state in which the electric blower 13 is standing still and thus the drive axis 15 is not rotating, the shifting of the belt is not complete. However, once the driving of the electric blower 13 is restarted, the belt 113 completely shifts to the idler 114. The same is true when the belt 113 is shifted from the idler 114 to the drive pulley 112.

The switching from the first suction mouth 81 to the second suction mouth 82 can be performed through the operation of the operation portion 152*a*. Specifically, when the first suction mouth 81 is used, the operation portion 152*a* is located at the right-hand end of the window 75*a*. When the operation portion 152*a* is moved to the left-hand end of the operation portion 152*a*, the fork 150 rotates counter-clockwise as seen from the front, and thus shifts the belt 113 from the drive pulley 112 to the idler 114. Simultaneously, the lever 154 moves down, and thereby presses down the rear portion of the lever 155. The front portion of the lever 155 moves up, and thus lifts up the end 161*b* of the crank 161. The crank 161 as a whole rotates in the bearings 162 in the direction opposite to that indicated by arrow B, and thus the other end 161*a* of the crank 161 lifts up the longer arm of the lever 132. As a result, the valve shaft 96 rotates in the direction opposite to that indicated by arrow A, and thus the switch valve 95 moves to the position where it keeps the inflow port 93 open and the inflow port 92 closed.

When dust is sucked in by the use of the second suction mouth 82, on a hard flooring material, the first bottom support 101 keeps the entrance of the second suction mouth 82 stably at a predetermined distance (0.8 mm to 2 mm) from the floor. Thus, a passage for dust is secured between the second suction mouth 82 and the floor. The second suction mouth 82 has a smaller opening area than the first suction mouth 81, and therefore the suction pressure concentrates in a narrow area. Accordingly, a high-speed suction air stream is produced at the entrance of the second suction mouth 82, and thus dust is acted upon by a suction pressure more powerful than by suction accompanied by the rotation of the agitator. The gap of 0.8 to 2 mm permits efficient suction of dust in the form of sand and powder.

When the second suction mouth 82 is used, the air stream sucked in passes below the transparent or semitransparent lid 86. This makes it possible to check directly and visually how dust is being sucked in. When dust obstructs the suction passage 85, it is possible to remove the lid 86 and dispose of the obstructing dust.

Dust can be sucked in not only by the use of the first suction mouth 81 or the second suction mouth 82 but also by the use of the flexible hose 33. The flexible hose 33 is detached from the connection pipe 78, and instead a suction tool such as a crevice nozzle or furniture brush is attached thereto. In this state, it is possible to perform cleaning in a narrow or high space that is difficult to reach with the suction mouth unit 70.

When cleaning is finished, the suction cleaner 1 is carried to a place where it is stored when not in use, and the cleaner main unit 10 is brought into the posture for storage, i.e., the dust collecting device holder 12 is held upright. This causes the rear portion of the suction mouth unit 70 to move down, with the result that the second bottom support 102 makes contact with the floor to support the suction mouth unit 70 and the first bottom support 101 moves off the floor. Also off the floor moves the outer circumference of the agitator 110. Accordingly, in this state, even if the electric blower 13 is still being driven, the agitator 110 never rakes the floor and thus never damages it.

So long as the dust collecting device holder 12 is held upright, the outer circumference of the agitator 110 never makes contact with the floor. Accordingly, even if it is left in this state for a long time, the bristles (or blades of rubber or soft synthetic resin) planted on the agitator 110 are never deformed.

When a large amount of dust has been collected in the dust collecting device 20, the latch 43 is released, and the dust collecting device 20 is pulled out to dispose of the dust inside. If necessary, the filter 28 is also cleaned. Then, the dust collecting device 20 is put back in position. Forming the dust cup 21 out of a transparent or semitransparent material makes it easy to check how much dust accumulate.

The second suction mouth 82 and the suction passage 85 may be given the greatest possible widths. Specifically, the second suction mouth 82 and the suction passage 85 (at its entrance) may be made so wide as to leave only the thickness of the left-hand and right-hand side walls of the suction mouth unit 70. This slightly diminishes the strength of the suction mouth unit 70, but helps widen the suction width of the second suction mouth 82, and thus helps further increase the suction ability.

Figure 10:
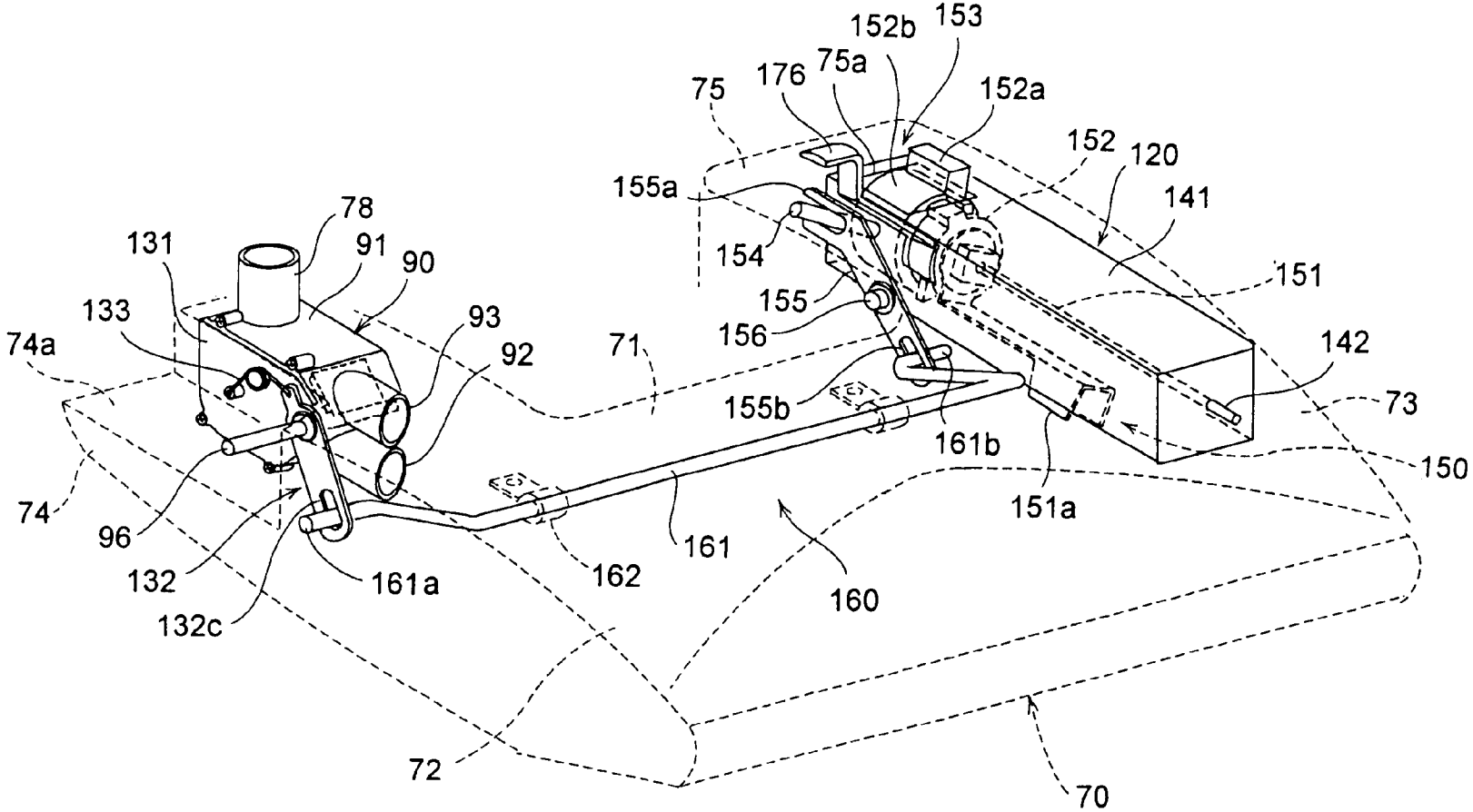
FIG. 10 is a perspective view, like FIG. 8, of the internal mechanism of the suction mouth unit of a second embodiment of the invention.
Figure 11:
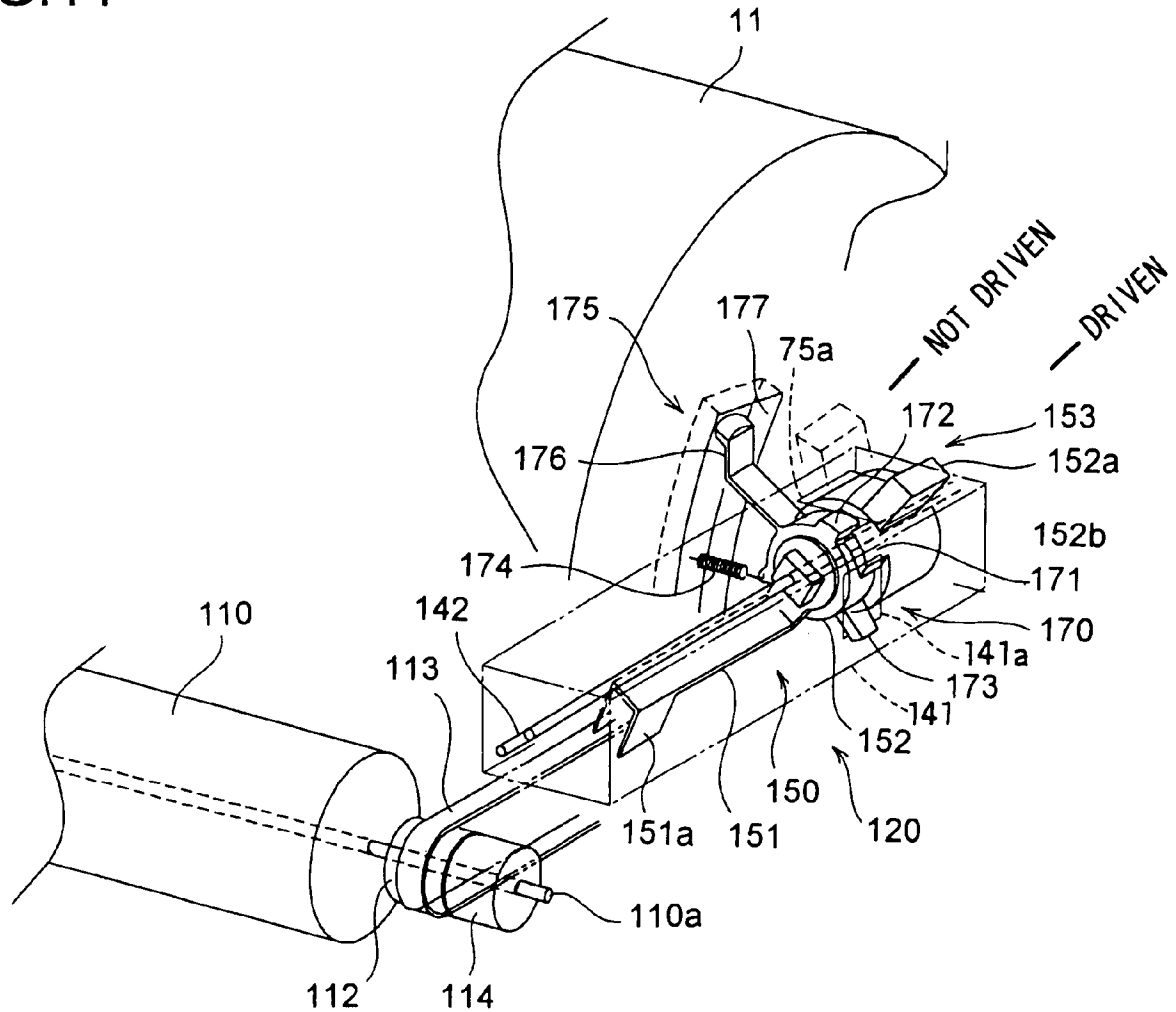
FIG. 11 is a perspective view of part of the internal mechanism of the suction mouth unit of the second embodiment, showing it as seen from a different direction as compared with FIG. 10.

FIGS. 10 and 11 show the suction cleaner of a second embodiment of the invention. In the second embodiment, the construction of the belt shifting device 120 is modified as compared with in the first embodiment, and these embodiments are the same in other respects. Accordingly, such components as are found also in the first embodiment will be identified with the same reference numerals as those used in the description of the first embodiment, and the explanations of those components will not be repeated. Likewise, also in the description of the third and the following embodiments, such components as have already been described will be identified with the previously used reference numerals, and their explanations will not be repeated.

In the second embodiment, coaxially with the pivot portion 152 of the fork 150 is arranged a rotary operation member 152*b*. The pivot portion 152 of the fork 150 and the rotary operation member 152*b* can be arranged coaxially by pivoting the rotary operation member 152*b* on the shaft 142. The rotary operation member 152*b* is located behind the pivot portion 152. The rotary operation member 152*b* and the lever 154 are provided on the part of the rotary operation member 152*b*. Between the rotary operation member 152*b* and the frame 141 is arranged an unillustrated toggle spring for crispy switching of the rotary operation member 152*b* between different angles.

Between the rotary operation member 152*b* and the pivot portion 152 is provided an engaging means 170. The engaging means 170 is composed of a projection 171 that protrudes from the rotary operation member 152*b* to overhang the outside of the pivot portion 152 and a projection 172 that protrudes from the outer circumference of the pivot portion 152. A tensile coil spring 174 (see FIG. 11) is strung between the pivot portion 152 and the frame 141 to load the pivot portion 152 with a force that tends to move it in the direction in which the projections 172 and 172 engage with each other.

From the outer circumference of the pivot portion 152 protrudes another projection 173 that is arranged at an angle relative to the projection 172. The projection 173 moves within a window 141*a* formed in the frame 141. The projection 173, by hitting the upper and lower edges of the window 141*a*, sets the limits of rotation of the pivot portion 152.

From the pivot portion 152 toward the blower shell 11 protrudes a lever 176. The head of the lever 176 shows outside the suction mouth unit 70, and fits in the arc-shaped groove 177 formed in an end surface of the blower shell 11. The arc-shaped groove 177 describes an arc about the drive axis 15. The lever 176 and the arc-shaped groove 177 together constitute a forcible rotating means 175 for forcibly rotating the fork 150.

Next, the workings of the suction cleaner 1 of the second embodiment will be described. As the cleaner main unit 10 is inclined from the posture for storage to the posture for cleaning operation, the arc-shaped groove 177 rotates so that the end thereof moves away from the lever 176. This permits the lever 176 to rotate without being affected by the arc-shaped groove 177.

Here, if the first suction mouth 81 is selected, the rotary operation member 152*b* is located at such an angle that the operation portion 152*a* hits the right-hand end stopper of the window 75*a* (the angle indicated as "DRIVEN" in FIG. 11). Under the force exerted by the tensile coil spring 174, the fork 150 rotates together with the rotary operation member 152*b*, and is thus located at such an angle that the belt 113 is aligned with the drive pulley 112. Accordingly, when the electric blower 13 is driven, the agitator 110 is driven via the belt 113.

The pivot portion 152 derives the motive force needed to shift the belt 113 from the force exerted by the tensile coil spring 174. Therefore, when the drive axis 15 is not rotating, the belt 113 does not need to be forcibly shifted to the drive pulley 112, and simply the tensile coil spring 174 can be left extended. When the drive pulley 115 starts to rotate, the force exerted by the tensile coil spring 174 permits the belt 113 to be shifted to the drive pulley 112 smoothly.

When the operation portion 152*a* or the pedal 134 is so operated that the second suction mouth 82 is selected, the rotary operation member 152*b* rotates to such an angle that the operation portion 152*a* hits the left-hand end stopper of the window 75*a* (at the angle indicated as "NOT DRIVEN" in FIG. 11). This causes the projection 171 to press the projection 172, and thus the pivot portion 152 is rotated counterclockwise as seen from the front against the force exerted by the tensile coil spring 174. As a result, the parallel walls 151*a* move to the position in which they make the belt 113 aligned with the idler 114, and thus the belt 113 is now wound on the idler 114. Accordingly, even when the electric blower 13 is driven, the agitator 110 is not driven but stands still.

When the first suction mouth 81 is selected, bringing the cleaner main unit 10 into the posture for storage (stand-by posture) actuates the forcible rotating means 175. Specifically, as the dust collecting device holder 12 becomes increasingly close to the upright state, the end of the arc-shaped groove 177 approaches the lever 176. Ultimately, the end of the arc-shaped groove 177 touches the lever 176, and then makes it rotate together with the cleaner main unit 10. Whereas the pivot portion 152 remains at the angle that it has thus far been assuming, the projection 172 moves away form the projection 171.

With the dust collecting device holder 12 in the upright state, the pivot portion 152 is displaced to such an angel that the parallel walls 151*a* align the belt 113 with the idler 114. At this time, even if the electric blower 13 continues to be driven, the belt 113 simply rotates the idler 114, and does not rotate the agitator 110. This prevents a floor from being damaged (or pile of a carpet from being plucked off) as a result of the agitator continuing to rotate at one place, and also prevents the agitator itself from being worn.

The agitator 110 can be stopped simply by bringing the cleaner main unit 10 into the posture for storage (stand-by posture) during cleaning. Thus, there is no need to operate a switch to stop the agitator 110. Bringing the cleaner main unit 10 into the posture for cleaning operation causes the pivot portion 152, under the force exerted by the tensile coil spring 174, to return to the original angle, and thus restarts the driving of the agitator 110.

As described above, the fork 150 can be moved separately from the rotary operation member 152*b*, which is coordinated with the suction mouth switching device 90. That is, the shifting of the belt 113 can be performed independently. In other words, the belt shifting device 120 and the suction mouth switching device 90 operate in an uncoordinated fashion. This feature can be exploited to achieve the following operation.

While dust is being sucked in through the first suction mouth 81 with the cleaner main unit 10 in the cleaning operation posture, the lever 176 is pressed to shift the belt 113 to the idler 114. This stops the agitator 110, but permits the suction of the air stream through the first suction mouth 81 to be continued. Thus, it is now possible to suck dust in through the first suction mouth 81 without raking the floor with the agitator 110. This mode of operation is suitable for a floor surface, such as a thin carpet, where a comparatively gentle suction pressure needs to be applied in a wide area. It is advisable to provide an appropriate locking means for preventing the lever 176 from returning to the original position even when released from the fingers.

Figure 12:
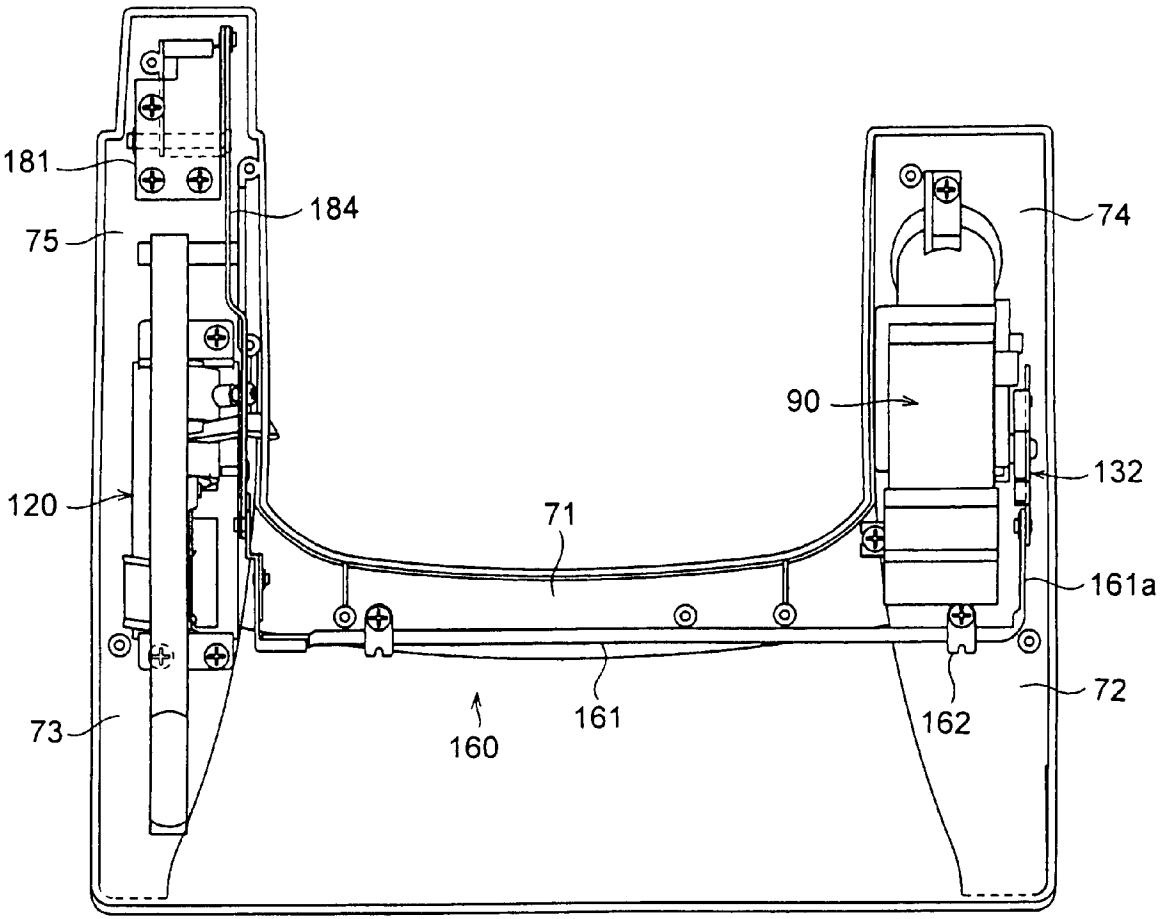
FIG. 12 is a bottom view of the shell of the suction mouth unit of the third embodiment.
Figure 13:
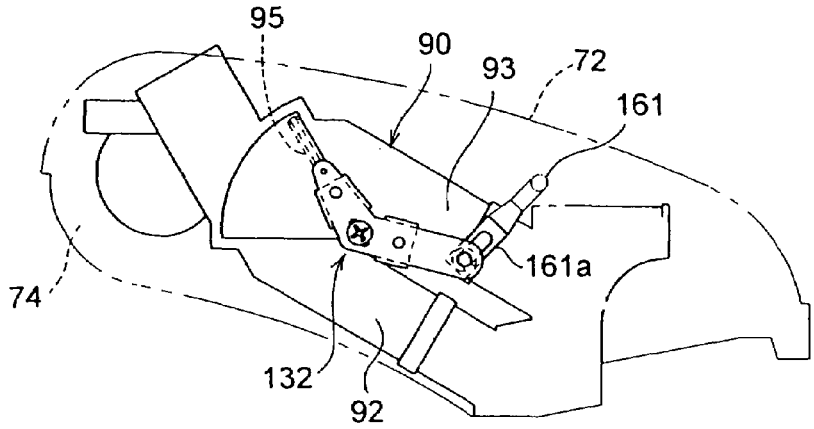
FIG. 13 is a diagram illustrating the operation of the internal mechanism of the suction mouth unit of the third embodiment, showing how the operation of the suction mouth switching device and the operation of the belt shifting device are coordinated.
Figure 13:
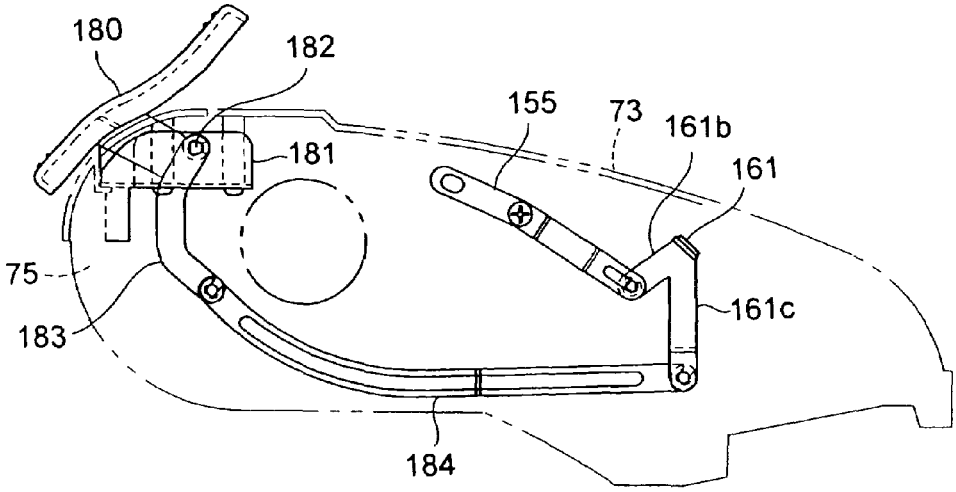
Figure 14:
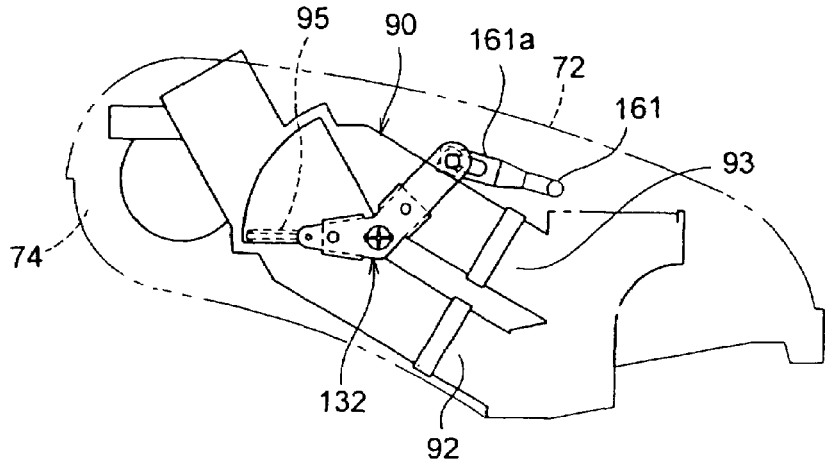
FIG. 14 is a diagram, like FIG. 13, illustrating the same operation in a different operation state.
Figure 14:
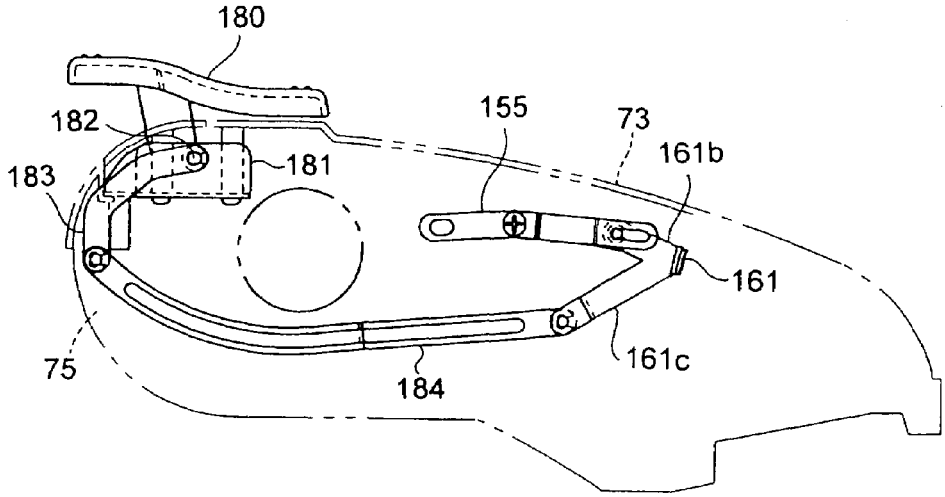

FIGS. 12 to 14 show the suction cleaner of a third embodiment of the invention. In the third embodiment, the mechanisms by which motive power is fed to the suction mouth switching device 90 and the belt shifting device 120 are modified. Specifically, in the first and second embodiments, the suction mouth switching device 90 is provided with the pedal 134, and the belt shifting device 120 is provided with the operation portion 152*a*; by contrast, in this embodiment, those mechanisms are unified into a single pedal 180 that is provided on the part of the belt shifting device 120.

Inside the rearward protruding portion 75 of the suction mouth unit 70 is fixed a fitting metal mount 181, and on this metal mount 181 is fitted the pedal 180. The pedal 180 has substantially a T-like shape as seen from the side, and the portion thereof corresponding to the vertical stroke of the T-like shape is linked to the metal mount 181 by a shaft 182 so that the pedal 180 is so supported as to be rotatable in a vertical plane. From the vertical stroke portion of the T-like shape protrudes an arm 183. To the tip end of the arm 183 is linked one end of a link 184. The other end of the link 184 is linked to an arm 161*c* provided at one end of the crank 161.

In the third embodiment, the crank 161 has a circular cross-section in the central portion thereof where it is pivoted by the bearings 162, but has the bent portions at both ends thereof formed flat. Moreover, the crank 161 has, in a portion thereof on the side of the belt shifting device 120, a separately formed metal member, composed of an end 161*b* and an arm 161*c*, welded thereto so as to have a shape as shown in the figures. To obtain higher strength, it is preferable to bend the crank 161 while it still has a circular cross-section throughout and thereafter form the ends thereof flat, rather than bending already flattened portions thereof.

FIG. 13 shows the state of the coordinating means 160 as observed when the first suction mouth 81 is selected. The front portion of the pedal 180 is lifted up, and the link 184 presses frontward the arm 161*c* of the crank 161. The end 161*a* of the crank 161 presses down the front portion of the lever 132. This causes the switch valve 95 to move to the position where it keeps the inflow port 92 open and the inflow port 93 closed. The end 161*b* presses down the front portion of the lever 155, and thus lifts up the rear portion of the lever 155. When the rear portion of the lever 155 lifts up, as described earlier in connection with the first and second embodiments, the lever 154 is pressed up, and thus the fork 150 rotates to the angle at which it aligns the belt 113 with the drive pulley 112. A toggle spring is provided only on the part of the belt shifting device 120.

FIG. 14 shows the state of the coordinating means 160 as observed when the second suction mouth 82 is selected. In this state, the rear portion of the pedal 180 is lifted up, and thus the link 184 pulls rearward the arm 161*c* of the crank 161. The end 161*a* of the crank 161 presses up the front portion of the lever 132, and the switch valve 95 moves to the position in which it keeps the inflow port 93 open and the inflow port 92 closed. The end 161*b* presses up the front portion of the lever 155, and thus presses down the rear portion of the lever 155. When the rear portion of the lever 155 goes down, as described earlier in connection with the first and second embodiments, the lever 154 is pulled down, and thus the fork 150 rotates to the angle at which it aligns the belt 113 with the idler 114.

FIG. 15 shows the suction cleaner of a fourth embodiment of the invention. The suction cleaner 1*a* of the fourth embodiment is characterized by the angle at which the flexible hose 33 runs from the suction mouth unit 70. In the suction cleaner 1 of the first embodiment, the connection pipe 78 to which the flexible hose 33 is connected protrudes nearly right upward; by contrast, in the suction cleaner 1*a* of the fourth embodiment, the connection pipe 78*a* is so arranged as to incline rearward.

The inclination angle of the connection pipe 78*a* is such that, when the dust collecting device holder 12 is inclined to assume the cleaning operation posture, i.e., when the handle 62 is brought down to a height of 60 cm to 80 cm from the floor, the spatial arrangement of the flexible hose 33 leading from the suction mouth unit 70 to the dust collecting device holder 12 is substantially straight as seen from the side. In other words, the inclination angle is such that, as seen from the side, the connection pipe 78*a* points to the connection pipe 34.

Setting in this way the angle at which the flexible hose 33 runs from the suction mouth unit 70 helps make the first air passage 31 more straight when dust is sucked in, and thus helps increase the flow efficiency of the air stream.

Figure 16:
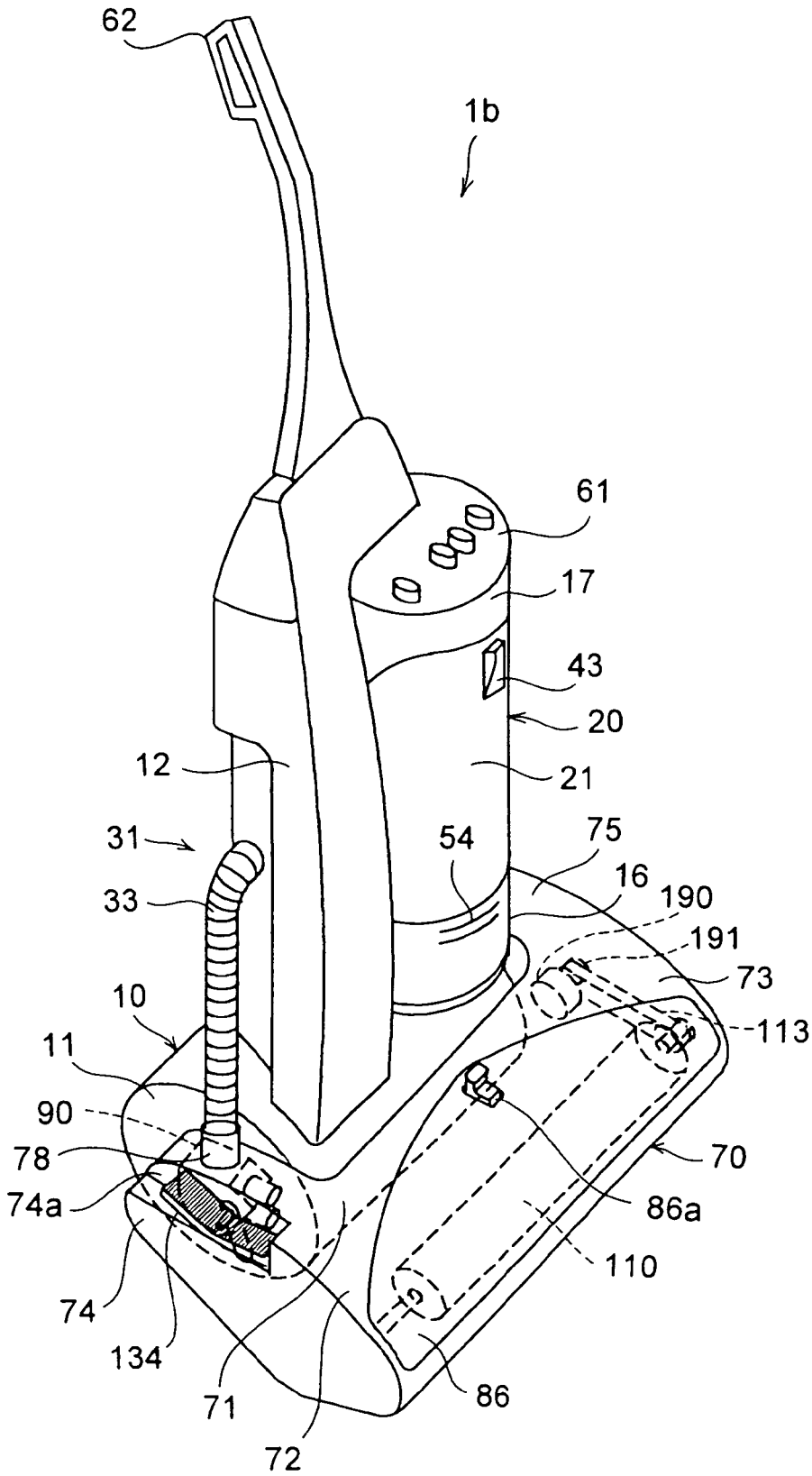
FIG. 16 is a perspective view of the suction cleaner of a fifth embodiment of the invention.
Figure 17:
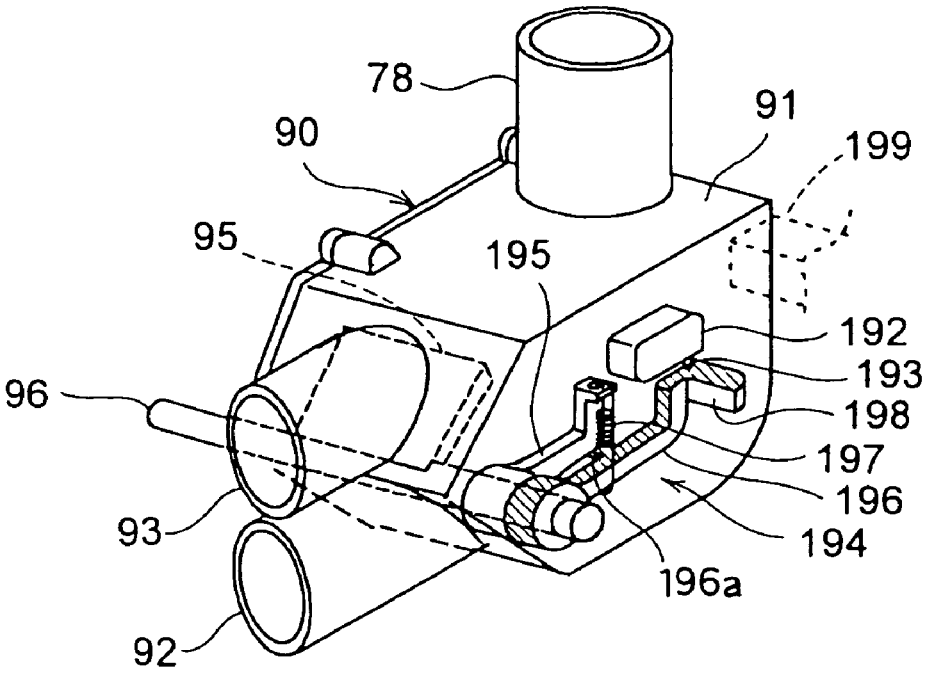
FIG. 17 is a perspective view of the suction mouth switching device of the fifth embodiment.
Figure 18:
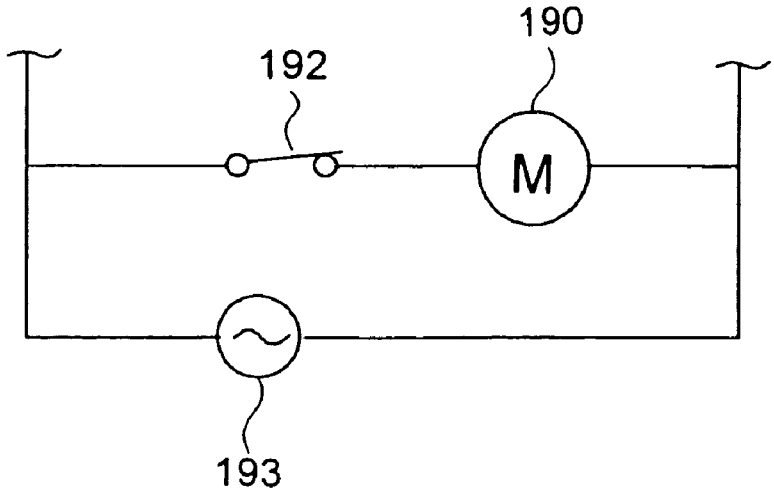
FIG. 18 is a partial electric circuit diagram of the fifth embodiment.

FIGS. 16 to 18 show the suction cleaner of a fifth embodiment of the invention. The suction cleaner 1*b* shown in those figures is characterized in that the agitator 110 is driven with motive power different from that with which the electric blower 13 is driven. As the source of motive power is used a small motor 190. The motor 190 is arranged inside the shell side piece 73, and has a drive pulley 191 fixed on the spindle thereof. On this drive pulley 191 is wound the belt 113.

In the fifth embodiment, whether or not to drive the agitator 110 is selected not by shifting the belt 113 but according to whether to drive or not the motor 190. This eliminates the need for the idler 114 and the belt shifting device 120 used in the first embodiment. FIG. 18 shows the part of the electric circuit that is relevant to the motor 190. The motor 190 is connected in series with a normally open switch 192 and is then connected to a power source 193.

Where the switch 192 is arranged is pictorially shown in FIG. 17. The switch 192 is a microswitch, and is fitted on the right-hand side surface of the valve case 91 of the suction mouth switching device 90. The actuator 193 of the switch 192 protrudes downward so as to be pressed by an arm 194 fitted to the valve shaft 96.

The arm 194 is a member composed of two arms, namely a first arm 195 fixed to the valve shaft 96 and a second arm 196 rotatably supported on the valve shaft 96. Between the first and second arms 195 and 196 is strung a tensile coil spring 197 so that the second arm 196 is pulled toward the first arm 195 until a projection 196*a* formed on a side surface of the former hits the latter. Only the second arm 196 reaches, at the tip end thereof, the actuator 193 of the switch 192. At the tip end of the second arm 196 is formed a pressure-receiving portion 198 that protrudes toward the cleaner main unit 10. Correspondingly to this pressure-receiving portion 198, in a side surface of the blower shell 11 is formed a projection-like pressing portion 199.

FIG. 17 shows a state in which the cleaner main unit 10 is in the cleaning operation posture and the first suction mouth 81 is selected. The pressing portion 199 on the side surface of the blower shell 11 is away from the pressure-receiving portion 198 of the second arm 196. The switch valve 95 keeps the inflow port 92 open and the inflow port 93 closed. The arm 194, with the second arm 196 thereof, is pressing the actuator 193 of the switch 192.

The second arm 196 hits the actuator 193 shortly before the valve shaft 96 and the first arm 195 reach their rotation limit. Thereafter, the tensile coil spring 197 expands to absorb the difference in angle between the first and second arms 195 and 196.

As a result of the actuator 193 being pressed, the normally open contact of the switch 192 closes. This causes the motor 190 to be supplied with electric current, and thus the motor 190 rotates to drive the agitator 110.

When the suction mouth switching device 90 is brought into a state in which it selects the second suction mouth 82, i.e., when the switch valve 95 is moved to the position in which it keeps the inflow port 93 open and the inflow port 92 closed, the first arm 195 rotates together with the valve shaft 96. The second arm 196, as a result of the projection 196*a* being pressed by the first arm 195, rotates together with the first arm 195, and thus the arm 194 moves away from the switch 192. This causes the normally open contact, which has thus far been closed, to open, and thus the switch 192 is brought into a cut-off state. Thus, the motor 190 stops, and the agitator 110 stops being driven.

In the state in which the first suction mouth 81 is selected, when the cleaner main unit 10 is brought into the posture for storage, i.e., when the dust collecting device holder 12 is turned upright, the pressing portion 199 presses the pressure-receiving portion 198 of the first arm 195. Then, while the valve shaft 96 maintains its angle, the second arm 196 alone rotates and moves away from the switch 192. This causes the normally open contact of the switch 192 to open, and thus the motor 190 stops. The agitator 110 also stops.

When the cleaner main unit 10 is brought into the cleaning operation posture, the second arm 196 returns to the original position, and closes the normally open contact of the switch 192. This restarts the driving of the agitator 110. The pressing portion 199 functions just like the forcible rotating means 175 used in the second embodiment.

Figure 19:
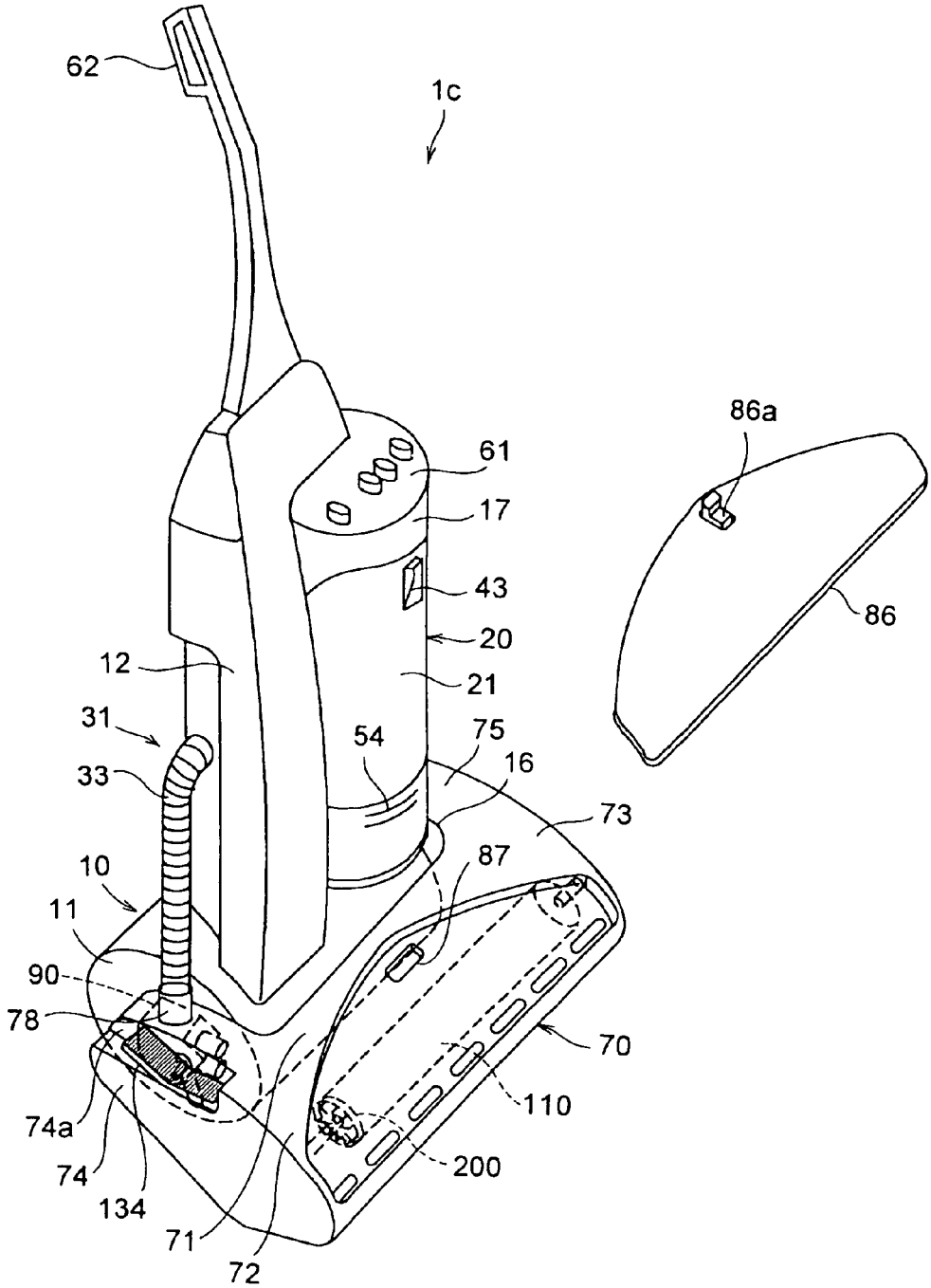
FIG. 19 is a perspective view of the suction cleaner of a sixth embodiment of the invention.

FIG. 19 shows the suction cleaner of a sixth embodiment of the invention. The suction cleaner 1*c* shown in this figure also is characterized in that the agitator 110 is driven with motive power different from that with which the electric blower 13 is driven. Here, as the source of motive power is used an air turbine that is rotated by the suction air stream. In the sixth embodiment, at the end of the agitator 110 is fitted a turbine wheel 200. Through an unillustrated nozzle, part of the suction air stream is blown onto the turbine wheel 200 so that, as the turbine wheel 200 is rotated thereby, the agitator 110 is rotated together. This construction requires neither a belt nor a motor.

There may be additionally provided a means for shutting off the air that is blown out through the nozzle or a means for changing the direction in which the air is blown out to make it possible to chose whether or not to drive the agitator 110. The constructions of the fifth and sixth embodiments may be used in combination.

Figure 20:
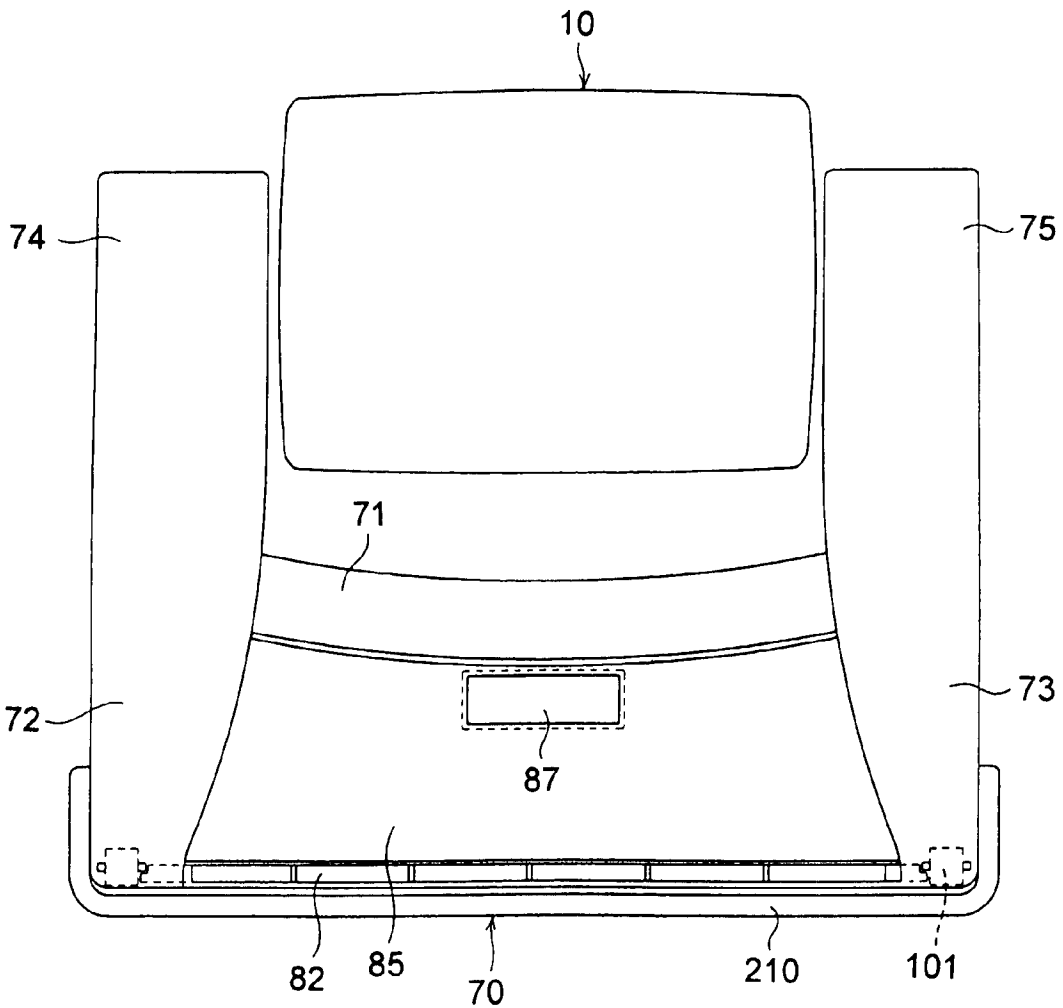
FIG. 20 is a top view of the suction mouth unit of a seventh embodiment of the invention.
Figure 21:
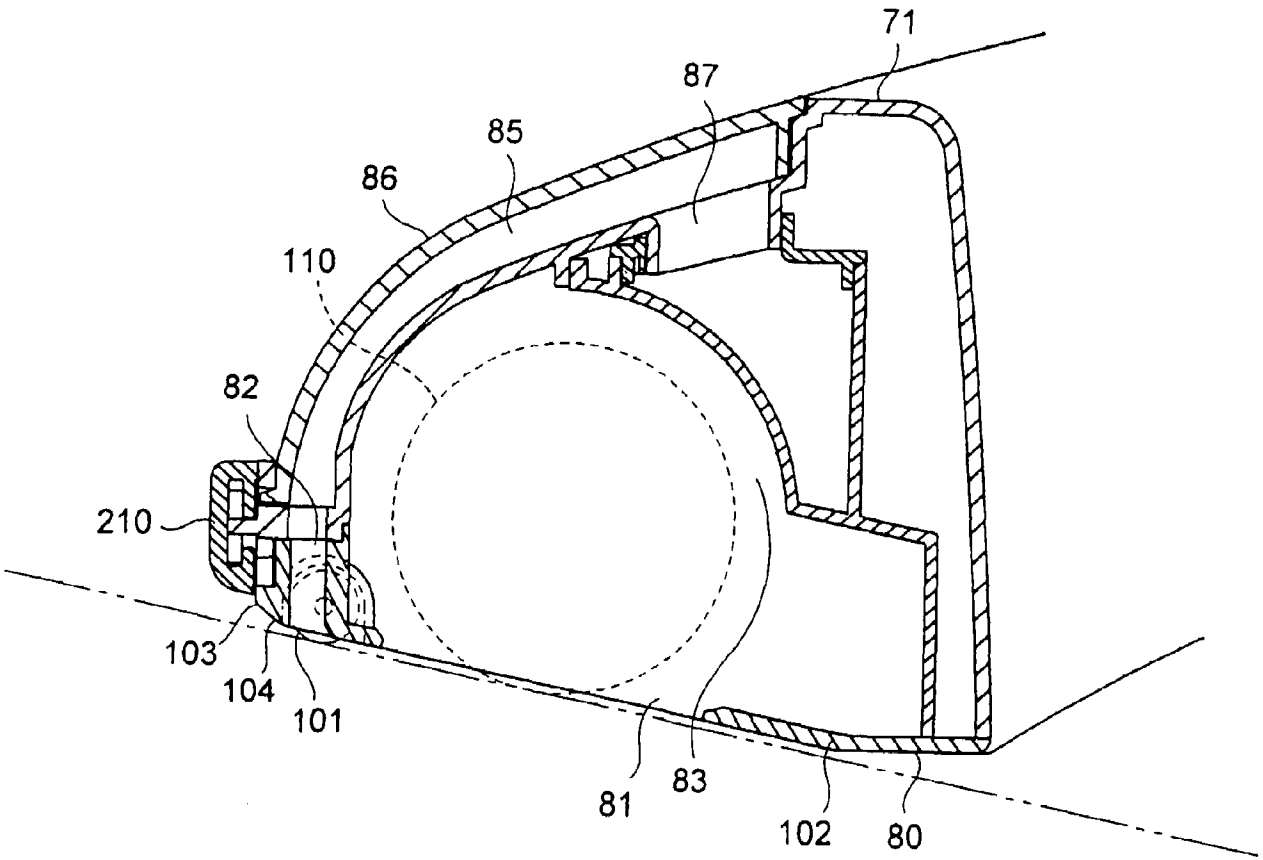
FIG. 21 is a partial vertical sectional view of the suction mouth unit of the seventh embodiment.
Figure 22:
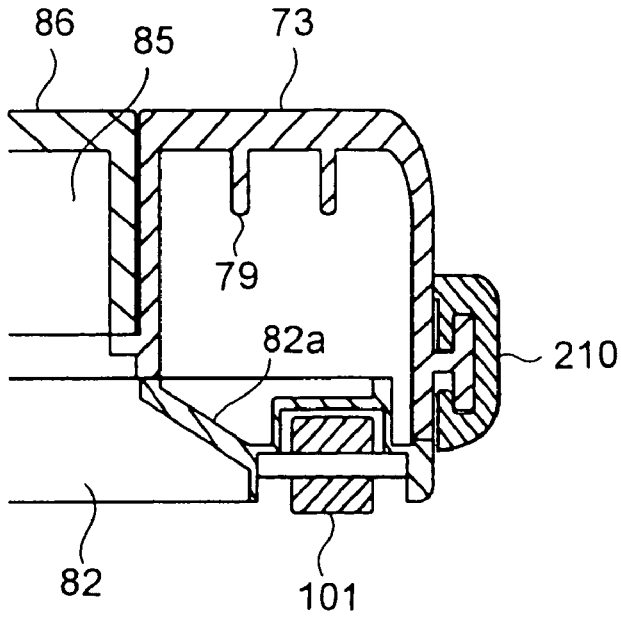
FIG. 22 is a partial vertical sectional view of the suction mouth unit of the seventh embodiment, showing it in a section perpendicular to FIG. 21.

FIGS. 20 to 22 show the suction cleaner of a seventh embodiment of the invention. This embodiment is characterized by the structure of the suction mouth unit 70. Specifically, in the embodiments presented thus far, for example as shown in FIG. 1, the lid 86 of the suction passage 85 covers a comparatively large width; by contrast, in the seventh embodiment, the widths of the suction passage 85 and the lid 86 are slightly smaller, and this makes clearer the feature that the shell side pieces 72 and 73 are so shaped as to be continuous to the front end of the suction mouth unit 70. This structure of the shell side pieces 72 and 73 helps increase the toughness of the front face of the suction mouth unit 70 against collision.

On the inner ceiling surfaces of the shell side pieces 72 and 73 are formed a plurality of reinforcement ribs 79 so as to extend in the front/rear direction (see FIG. 22). The front ends of the reinforcement ribs 79 reach the front edges of the shell side pieces 72 and 73. This helps further increase the toughness of the suction mouth unit 70 against collision.

Even though, as described above, the suction passage 85 has a smaller width, the second suction mouth 82 should better be saved from being given a smaller width. Accordingly, as shown in FIG. 22, the edge of the suction passage 85 is connected to the edge of the second suction mouth 82 by a guide wall 82*a* that becomes increasingly wider downward. This makes it possible, even though the suction passage 85 is given a smaller width, to give the second suction mouth 82 a width comparable with the width given thereto in the previous embodiments.

Moreover, in the seventh embodiment, a bumper 210 formed out of soft synthetic resin is fitted on the suction mouth unit 70 so as to cover the front face to the left-hand and right-hand faces of the suction mouth unit 70. Under the bumper 210 is formed a guide 103 having a slanted surface 104 for riding over dust.

The height ($H_2$ in FIG. 5) from the floor to the lower front edge of the guide 103 is about 3 mm (which may be about 3 mm to 4.5 mm) greater than the height ($H_1$ in FIG. 5) from the floor to the entrance of the second suction mouth 82. Thus, even with the front portion of the bottom plate 80 kept in contact with a carpet, the guide 103 does not push around dust on the carpet. The guide 103 rides over a piece of dust, if it has the size of a rice grain, and invites it into the first suction mouth 81. To obtain satisfactory dust riding-over performance, the slanted surface 104 is advisably given an inclination not larger than 40° to 50° relative to the horizontal plane.

Figure 23:
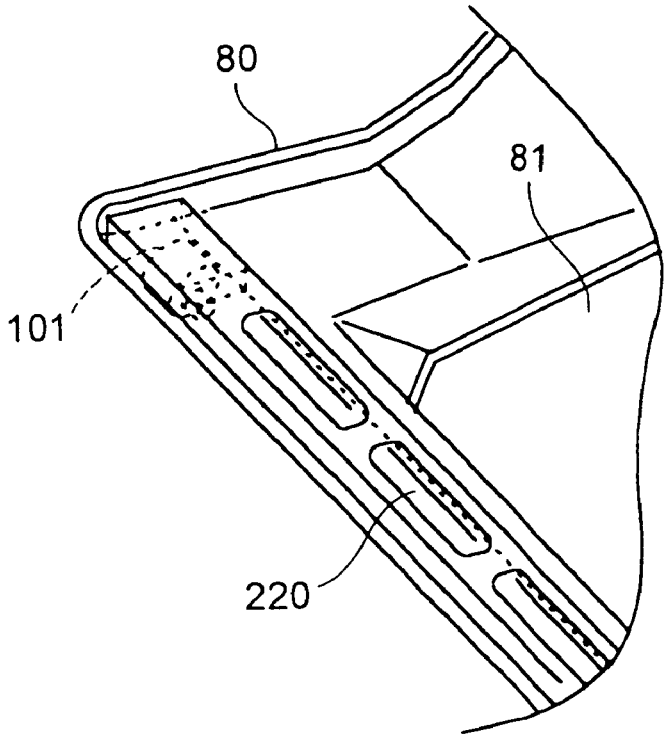
FIG. 23 is a partial perspective view of the bottom plate of the suction mouth unit of an eighth embodiment of the invention.

The embodiments shown in FIG. 23 and the following drawings relate to structures for maintaining or increasing the suction power through the second suction mouth 82, and these structures are applicable in any of the embodiments described thus far.

Figure 24:
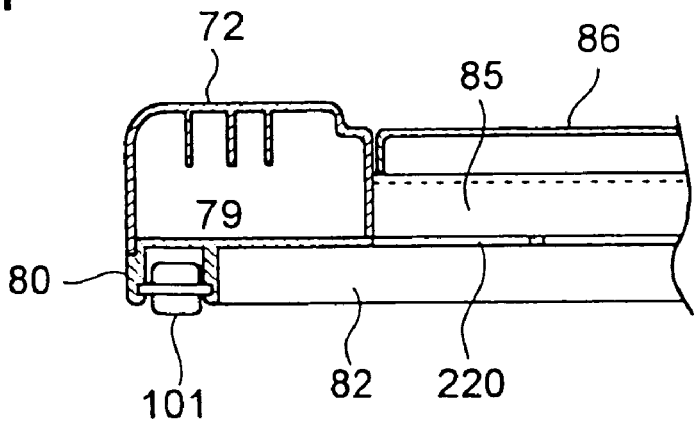
FIG. 24 is a partial vertical sectional view of the suction mouth unit of the eighth embodiment.
Figure 25:
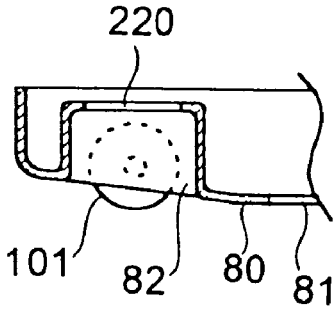
FIG. 25 is a partial vertical sectional view of the bottom plate of the suction mouth unit of the eighth embodiment, showing it in a section perpendicular to FIG. 24.

FIGS. 23 to 25 show the suction cleaner of an eighth embodiment of the invention. In the eighth embodiment, as the second suction mouth 82, a downward facing groove is formed in the bottom plate 80, and in a ceiling portion of the groove is formed a throughflow port 220 that leads to the suction passage 85. This makes it possible to match the width to be given to the second suction mouth 82 with the width of the suction passage 85.

The throughflow port 220 consists of a plurality of small holes arranged in a laterally extending row, and thus a large piece of dust is caught there so as not to obstruct the suction passage 85. Moreover, even when any of the small holes is obstructed with dust, the air stream can be sucked in through the other small holes, and this prevents overheating of the electric blower 13.

Figure 26:
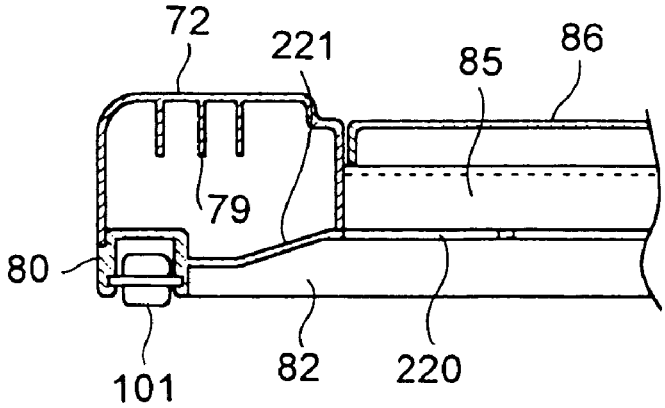
FIG. 26 is a partial vertical sectional view, like FIG. 24, of the suction mouth unit of a ninth embodiment of the invention.

FIG. 26 shows the suction cleaner of a ninth embodiment of the invention. In the ninth embodiment, the edge of the second suction mouth 82 is connected to the edge of the throughflow port 220 by a slanted guide wall 221. This permits the air stream sucked in through the second suction mouth 82 in an edge portion thereof to be smoothly guided to the throughflow port 220.

Figure 27:
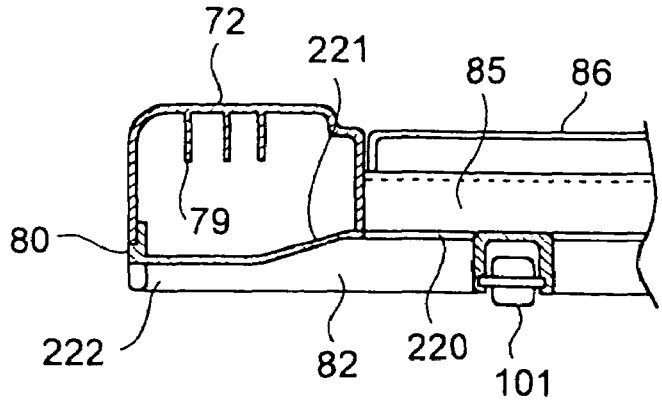
FIG. 27 is a partial vertical sectional view, like FIG. 24, of the suction mouth unit of a tenth embodiment of the invention.
Figure 28:
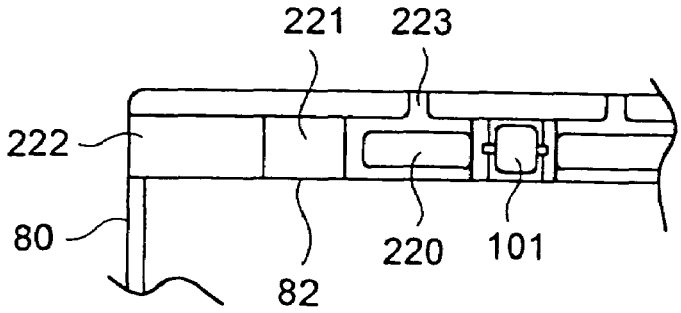
FIG. 28 is a bottom view of the suction mouth unit of the tenth embodiment.

FIGS. 27 and 28 show the suction cleaner of a tenth embodiment of the invention. In the tenth embodiment, the bottom support 101 is moved closer to the center of the second suction mouth 82, and at the ends of the second suction mouth 82 are formed communicating grooves 222 that are open toward the side faces of the suction mouth unit 70. Moreover, as shown in FIG. 28, at different places in the second suction mouth 82 are formed communicating grooves 223 that are open to the front face of the suction mouth unit 70. These communicating grooves 222 and 2223 makes it possible to efficiently suck in, at the side and front faces of the suction mouth unit 70, dust present where the floor meets walls.

Figure 29:
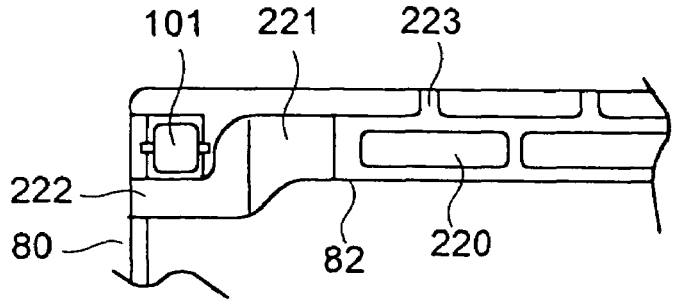
FIG. 29 is a bottom view, like FIG. 28, of an eleventh embodiment of the invention.

FIG. 29 shows the suction cleaner of an eleventh embodiment of the invention. The eleventh embodiment is a modified version of the tenth embodiment. Specifically, whereas the bottom support 101 is arranged in the front corners of the bottom surface of the suction mouth unit 70 as in the previous embodiments, the communicating grooves 222 are so formed as to avoid the bottom support 101 by running behind it. This construction offers the same advantages as the tenth embodiment, and makes it possible to efficiently suck in dust at the front face.

Figure 30:
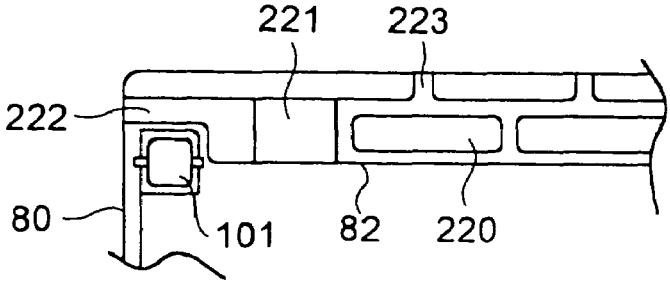
FIG. 30 is a bottom view, like FIG. 28, of a twelfth embodiment of the invention.

FIG. 30 shows the suction cleaner of a twelfth embodiment of the invention. The twelfth embodiment is also, like the eleventh embodiment, a modified version of the tenth embodiment. Here, the bottom support 101 is moved rearward so that the communicating grooves 222 run in front of the bottom support 101. In this construction, the communicating grooves 222 connect straight to the second suction mouth 82, and this results in higher dust suction efficiency than in the eleventh embodiment.

It is to be understood that the embodiments described above are merely examples of how the present invention is implemented and thus are not meant to limit the scope of the invention in any way; that is, many variations and modifications are possible within the scope of the subject matter of the invention. For example, although the suction mouth switching device 90 uses a plate-shaped switch valve 95 to open and close the inflow ports 92 and 93, it is also possible to use instead any other type of valve; for example, it is possible to use one of many types of valve, such as a ball valve and a pinch valve, that are used to control the flow of fluid. Instead of transmitting an operating force from an operation portion, such as a pedal, by way of a linking mechanism to the valve, it is also possible to directly move the valve by the use of a motor or a solenoid.

Although the suction mouth switching device 90 so operates as to keep one of the first and second suction mouths 81 and 82 completely open and the other completely closed, it is also possible to configure it so that it can keep the first suction mouth 81 open while keeping the second suction mouth 82 completely or partly open. This makes it possible to suck in dust widely through both the first and second suction mouths 81 and 82. So long as the opening area of the second suction mouth is small, the dust suction efficiency is not affected greatly.

Although all the embodiments deal with cases in which the present invention is applied to upright-type suction cleaners comprising a suction mouth unit rotatably coupled to a cleaner main unit, of all the claims of the present application, those which do not comprise a cleaner main unit and a suction mouth unit coupled together are applicable also to canister-type suction cleaners, i.e., those in which a cleaner main unit and a suction mouth unit are coupled together by a hose.

INDUSTRIAL APPLICABILITY

As described above, according to the present invention, in a suction cleaner, a plurality of suction mouths are formed in a suction mouth unit and one of those suction mouths is fitted with an agitator so that it is possible to selectively use either the suction mouth fitted with the agitator or a suction mouth that is not fitted with an agitator. Thus, the present invention is very useful for the maintenance of a comfortable living space.

The invention claimed is:

1. A suction cleaner, comprising:

an electric blower for producing an airstream;

a suction mouth unit through which the air stream produced by the electric blower is sucked in together with dust; and a dust collecting device into which the air stream and dust sucked in through the suction mouth unit are introduced to collect the dust, wherein the suction mouth unit comprises:

a first suction mouth;

a second suction mouth formed in at least part of a region in front of the first suction mouth with said first and second suction mouths being generally parallel; and an agitator arranged in the first suction mouth, the suction cleaner further comprising:

a suction mouth switching device configured to permit selective use of the first suction mouth and the second suction mouth, wherein the agitator is driven when suction is performed through the first suction mouth;

wherein a motive power transmission mechanism for transmitting motive power to the agitator includes a drive pulley that rotates together with the agitator, an idler that can rotate independently of the agitator, and a belt that is shifted by a belt shifting device between a state wound on the drive pulley and a state wound on the idler; and wherein, of the suction mouth switching device and the belt shifting device, one is arranged on one of a left-hand and a right-hand side of the suction mouth unit and the other is arranged on the other side of the suction mouth unit, and the suction mouth switching device and the belt shifting device are linked together by coordinating means so that switching of the suction mouths and shifting of the belt are performed in a coordiated fashion.

2. The suction cleaner according to claim 1, wherein the agitator is driven with motive power different from motive power with which the electric blower is driven.

3. The suction cleaner according to claim 2, wherein a cleaner main unit is rotatably coupled to the suction mouth unit, and driving of the agitator is stopped coordinatedly when the cleaner main unit is brought into a storage posture.

4. The suction cleaner according to claim 1, wherein, when one of the suction mouth switching device and the belt shifting device is operated, the other is operated in a coordinated fashion therewith.

5. The suction cleaner according to claim 1, wherein the belt shifting device can be operated also in an uncoordinated fashion with the suction mouth switching device.

6. The suction cleaner according to claim 1, wherein the suction mouth switching device includes a switch valve of which a valve shaft has a lever formed integrally therewith, and the lever is used as a component belonging to the coordinating means.

7. The suction cleaner according to claim 1, wherein a second suction mouth having a smaller opening area than the first suction mouth is formed near the first suction mouth.

8. The suction cleaner according to claim 1, wherein a cleaner main unit is rotatably coupled to the suction mouth unit, and driving of the agitator is stopped, by shifting the belt, coordinatedly when the cleaner main unit is brought into a storage posture.

* * * * *